US008057194B2

(12) United States Patent
Stover

(10) Patent No.: US 8,057,194 B2
(45) Date of Patent: Nov. 15, 2011

(54) COMPRESSOR WITH DISCHARGE MUFFLER ATTACHMENT USING A SPACER

(75) Inventor: Christopher Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 303 days.

(21) Appl. No.: 11/998,442

(22) Filed: Nov. 29, 2007

(65) Prior Publication Data

US 2008/0166252 A1 Jul. 10, 2008

Related U.S. Application Data

(60) Provisional application No. 60/872,590, filed on Dec. 1, 2006.

(51) Int. Cl.
*F04B 39/00* (2006.01)
*F16K 17/00* (2006.01)

(52) U.S. Cl. ..... 417/312; 181/403; 181/237

(58) Field of Classification Search ..... 417/312; 181/403, 237; 403/167, 168, 408.1; 267/293
See application file for complete search history.

(56) References Cited

U.S. PATENT DOCUMENTS 3,006,160 A * 10/1961 Heidorn ..... 62/296
4,418,790 A * 12/1983 Agnew ..... 181/268
4,759,422 A 7/1988 Belley
4,815,951 A 3/1989 Kakuda et al.
4,854,417 A * 8/1989 Uesugi et al. ..... 181/272
4,865,531 A 9/1989 Kakuda et al.
5,022,146 A 6/1991 Gannaway et al.
5,074,760 A 12/1991 Hirooka et al.
5,108,274 A 4/1992 Kakuda et al.
5,208,429 A 5/1993 Field
5,213,489 A * 5/1993 Kawahara et al. ..... 418/55.1
5,339,652 A 8/1994 Dreiman
5,348,267 A * 9/1994 Lanting et al. ..... 248/635
5,395,214 A 3/1995 Kawahara et al.
5,422,444 A * 6/1995 Doragrip ..... 181/230
RE35,216 E * 4/1996 Anderson et al. ..... 417/310
5,547,344 A 8/1996 Sugiyama et al.
5,596,879 A 1/1997 Burkhart et al.
5,723,827 A 3/1998 Sasaki et al.
5,733,108 A * 3/1998 Riffe ..... 417/542
5,883,342 A * 3/1999 Wolpert ..... 181/230
6,017,205 A 1/2000 Weatherston et al.
6,142,741 A 11/2000 Nishihata et al.
6,158,989 A 12/2000 Barito
6,171,084 B1 1/2001 Wallis et al.
6,176,687 B1 1/2001 Kim et al.
6,213,732 B1 4/2001 Fujio
6,225,566 B1 * 5/2001 Dienst ..... 174/138 E
6,254,365 B1 7/2001 Nakanishi
6,264,443 B1 7/2001 Bariot
6,312,233 B1 11/2001 Ahn et al.
6,341,662 B1 * 1/2002 Karlsson ..... 181/230
6,398,520 B2 6/2002 Han
6,422,338 B1 * 7/2002 Menzel et al. ..... 181/230

(Continued)

*Primary Examiner* — Devon C Kramer
*Assistant Examiner* — Nathan Zollinger
(74) *Attorney, Agent, or Firm* — Harness, Dickey & Pierce, P.L.C.

(57) ABSTRACT

A muffler that is externally mounted to a housing shell of a compressor. To externally mount the muffler to the housing shell and prevent unnecessary vibration of the muffler during compressor operation, an attachment device connects an essentially central portion of the muffler to the housing shell. The attachment device may also be adapted to house a pressure- or temperature-related sensor device.

18 Claims, 20 Drawing Sheets

U.S. PATENT DOCUMENTS

| | | | | |
|---|---|---|---|---|
| 6,499,977 | B2 | 12/2002 | Barito et al. | |
| 6,658,885 | B1 | 12/2003 | Zhou et al. | |
| 6,837,335 | B2 * | 1/2005 | Jankowski | 181/243 |
| 7,174,991 | B1 * | 2/2007 | Gunnarsson et al. | 181/231 |
| 7,293,629 | B2 * | 11/2007 | Nasuno et al. | 181/231 |
| 7,380,637 | B2 * | 6/2008 | Sieben et al. | 181/240 |
| 2002/0006342 | A1 | 1/2002 | Han | |
| 2002/0006343 | A1 | 1/2002 | Barito et al. | |
| 2002/0176739 | A1 * | 11/2002 | Goto et al. | 403/301 |
| 2003/0108438 | A1 | 6/2003 | Kim et al. | |
| 2004/0165998 | A1 | 8/2004 | Tadano et al. | |
| 2004/0165999 | A1 | 8/2004 | Tadano et al. | |
| 2004/0234386 | A1 | 11/2004 | Chumley et al. | |
| 2004/0234387 | A1 | 11/2004 | Marshall et al. | |
| 2005/0025566 | A1 * | 2/2005 | Hasegawa | 403/408.1 |
| 2005/0276711 | A1 | 12/2005 | Marshall et al. | |

* cited by examiner

COMPRESSOR WITH DISCHARGE MUFFLER ATTACHMENT USING A SPACER

FIELD

The present invention relates to compressors and, more particularly, to compressors with an externally mounted discharge muffler.

BACKGROUND

The statements in this section merely provide background information related to the present disclosure and may not constitute prior art.

A class of machines exist in the art generally known as "scroll machines" for the displacement of various types of fluids. Such apparatus may be configured as an expander, a displacement engine, a pump, a compressor, etc., and many features of the present teachings are applicable to any one of these machines. For purposes of illustration, however, the disclosed machines are in the form of a hermetic refrigerant compressor. Generally, a scroll machine comprises two spiral scroll wraps of similar configuration, each mounted on a separate end plate to define a scroll member.

The two scroll members are typically inter-fitted together with one of the scroll wraps being rotationally displaced 180° from the other. The machine operates by orbiting one scroll member (the "orbiting scroll") with respect to the other scroll member (the "fixed scroll" or "non-orbiting scroll") to make moving line contacts between the flanks of the respective spirals, defining isolated, crescent-shaped pockets of fluid moving from an inlet to an outlet.

The spirals are commonly formed as involutes of a circle, and ideally there is no relative rotation between the scroll members during operation; i.e., the motion is purely curvilinear translation (i.e., no rotation of any line in the body). The fluid pockets carry the fluid to be handled from a first zone in the scroll apparatus where a fluid inlet is provided, to a second zone in the apparatus where a fluid outlet is provided. The volume of a sealed pocket changes as it moves from the first zone to the second zone. At any one instant in time, there will be at least one pair of sealed pockets; and when there are several pairs of seal pockets at once, each pair will have different volumes. In a compressor, the second zone (or outlet) is at higher pressure than the first zone (or inlet) and is physically located centrally in the apparatus, the first zone being located at the outer periphery of the apparatus.

Two types of contacts define the fluid pockets defined between the scroll members: axially extending tangential line contacts between the spiral faces or flanks of the wraps caused by radial forces ("flank sealing"), and area contacts caused by axial forces between the plain edge surface (the "tips") of each ramp and the opposite end plate ("tip sealing"). For higher efficiency, good sealing must be achieved for both types of contacts.

The concept of a scroll-type machine has been recognized as having distinct advantages. For example, scroll machines have high isentropic and volumetric efficiency, and, hence, are relatively small and lightweight for a given capacity. They are, typically, quieter and vibration-less than many compressors types because they do not use large reciprocating parts (e.g., pistons, connecting rods, etc.), and because all fluid flow is in one direction with simultaneous compression in plural opposed pockets, there are less pressure-created vibrations. Such machines also tend to have higher reliability and durability because of the relatively few moving parts utilized, the relatively low velocity of movement between the scrolls, and an inherent forgiveness to fluid contamination.

Scroll compressors should not be rotated in reverse, however, as the scrolls can become damaged. One way a scroll compressor may operate in reverse in when compressed refrigerant remaining in the discharge line returns to the compressor and cause the scrolls to run in reverse. This reverse rotation of the scrolls may damage compressor components, including the scrolls, as high-pressure fluid flows to the lower-pressure inlet side of the scrolls. Accordingly, a short discharge line minimizes the volume of refrigerant contained therein and, once the compressor has shut down, a minimal amount of gas will return to the compressor and cause the scrolls to run in reverse.

With an externally mounted muffler, a short discharge line is prone to break because the muffler's larger mass vibrates while the compressor is running. To correct this, the discharge tube for an externally mounted muffler may have generally a longer length of tubing to the compressor. The longer discharge tubing, however, increases the volume of refrigerant present in the discharge line and cause the scrolls to reverse orbit upon shut down.

SUMMARY

The present teachings provide a muffler that is externally mounted to a shell of a compressor. To externally mount the muffler to the shell and prevent unnecessary vibration of the muffler during compressor operation, an attachment device connects an essentially central portion of the muffler to the housing shell. The attachment device may house a pressure- or temperature-related sensor device.

Further areas of applicability will become apparent from the description provided herein. It should be understood that the description and specific examples are intended for purposes of illustration only and are not intended to limit the scope of the claims.

DRAWINGS

The drawings described herein are for illustration purposes only and are not intended to limit the scope of the present disclosure in any way.

DETAILED DESCRIPTION

Figure 1:
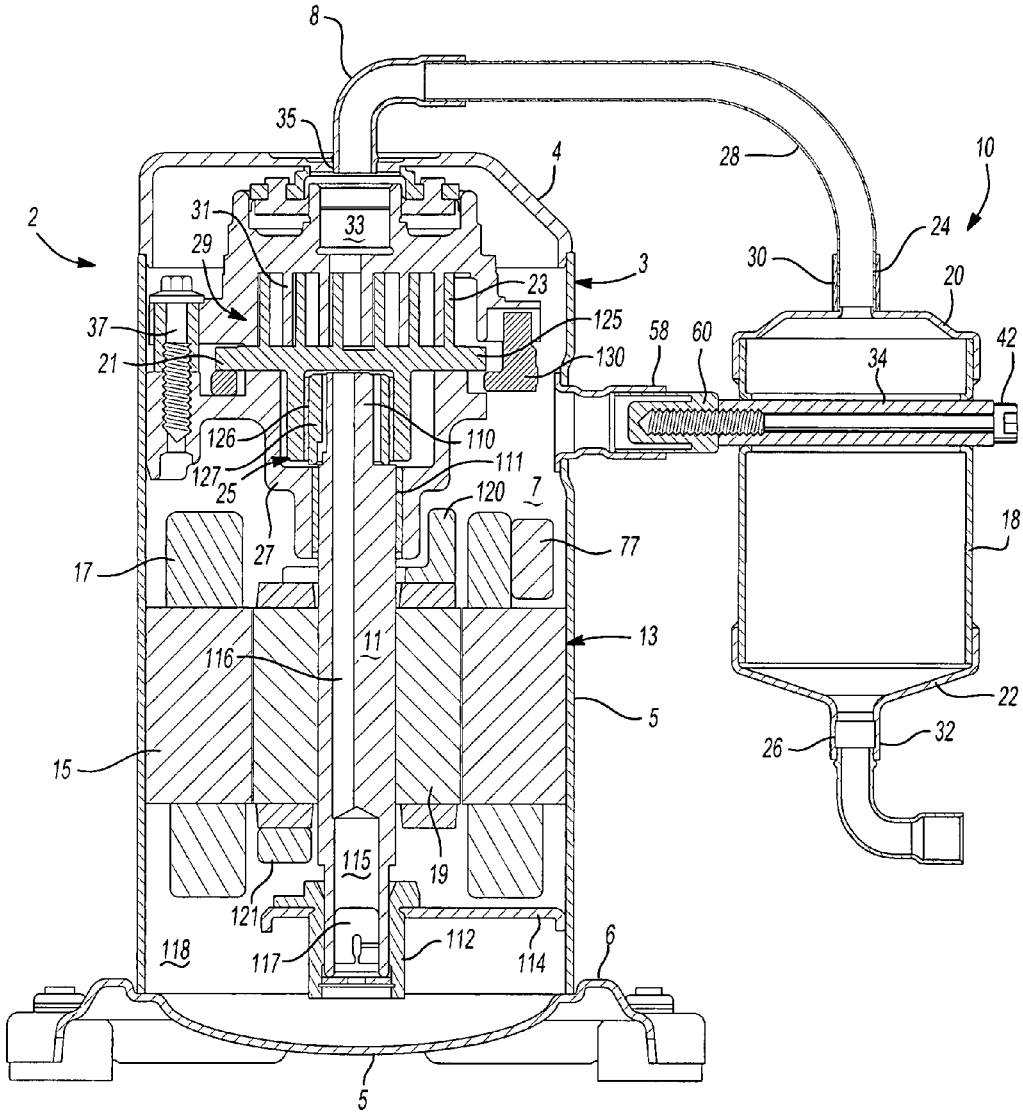
FIG. 1 is a cross-sectional view of a scroll compressor including a discharge muffler according to the present teachings.

The following description is merely exemplary in nature and is not intended to limit the present disclosure, application, or uses. It should be understood that throughout the drawings, corresponding reference numerals indicate like or corresponding parts and features.

With particular reference to FIG. 1, the compressor 2 is shown to include a generally cylindrical hermetic shell 3 having a welded cap 4 at a top portion and a base 5 having a plurality of feet 6 welded at a bottom portion. The cap 4 and the base 5 are fitted to the shell 3 such that an interior volume 7 of the compressor 2 is defined. The cap 4 is provided with a discharge fitting 8 and an inlet fitting (not shown), disposed generally between the cap 4 and base 5. A discharge muffler system 10 according to the present teachings is in fluid communication with discharge fitting 8.

A drive shaft or crankshaft 11 having an eccentric pin 110 at the upper end thereof is rotatably journaled in a bearing 111 in the main bearing housing 27. A second bearing 112 is disposed in the lower bearing housing 114. The crankshaft 11 has a relatively large diameter concentric bore 115 at the lower end which communicates with a radially outwardly inclined smaller diameter bore 116 extending upward therefrom to the top of the crankshaft 11. A stirrer 117 is disposed within the bore 115. The lower portion of the interior shell 7 defines an oil sump 118 filled with lubricating oil to a level slightly below the lower end of the rotor 19, and the bore 115 acts as a pump to pump lubricating fluid up the crankshaft 11 and into passageway 116 and ultimately to all of the various portions of the compressor 2 which require lubrication.

The crankshaft 11 is rotatively driven by an electric motor including a stator 15 and windings 17 passing therethrough. The rotor 19 is press fitted on the crankshaft 11 and has upper and lower counterweights 120 and 121, respectively.

The upper surface of the main bearing housing 27 is provided with a flat thrust bearing surface 125 on which an orbiting scroll member 21 is disposed having the usual spiral vane or wrap 23 on the upper surface thereof. A cylindrical hub 25 downwardly projects from the lower surface of orbiting scroll member 21 which has a journal bearing 126 and drive bushing 127.

Crank pin 110 has a flat on one surface which drivingly engages a flat surface formed in a portion of the drive bushing 127 to provide a radially compliant driving arrangement. An Oldham coupling 130 is provided positioned between the orbiting scroll member 21 and the bearing housing 27 and is keyed to the orbiting scroll member 21 and a non-orbiting scroll member 29 to prevent rotational movement of the orbiting scroll member 21.

Non-orbiting scroll member 29 also includes a wrap 31 positioned in meshing engagement with the wrap 23 of the orbiting scroll member 21. Non-orbiting scroll member 29 has a centrally disposed discharge passage 33, which communicates with an upwardly open recess 35 formed in outer surface of cap 4. Recess 35 is in fluid communication with the discharge fitting 8 such that compressed fluid exits the compressor 2. Non-orbiting scroll member 29 is designed to be fixedly mounted to bearing housing 29 by a fastener 37.

Figure 2:
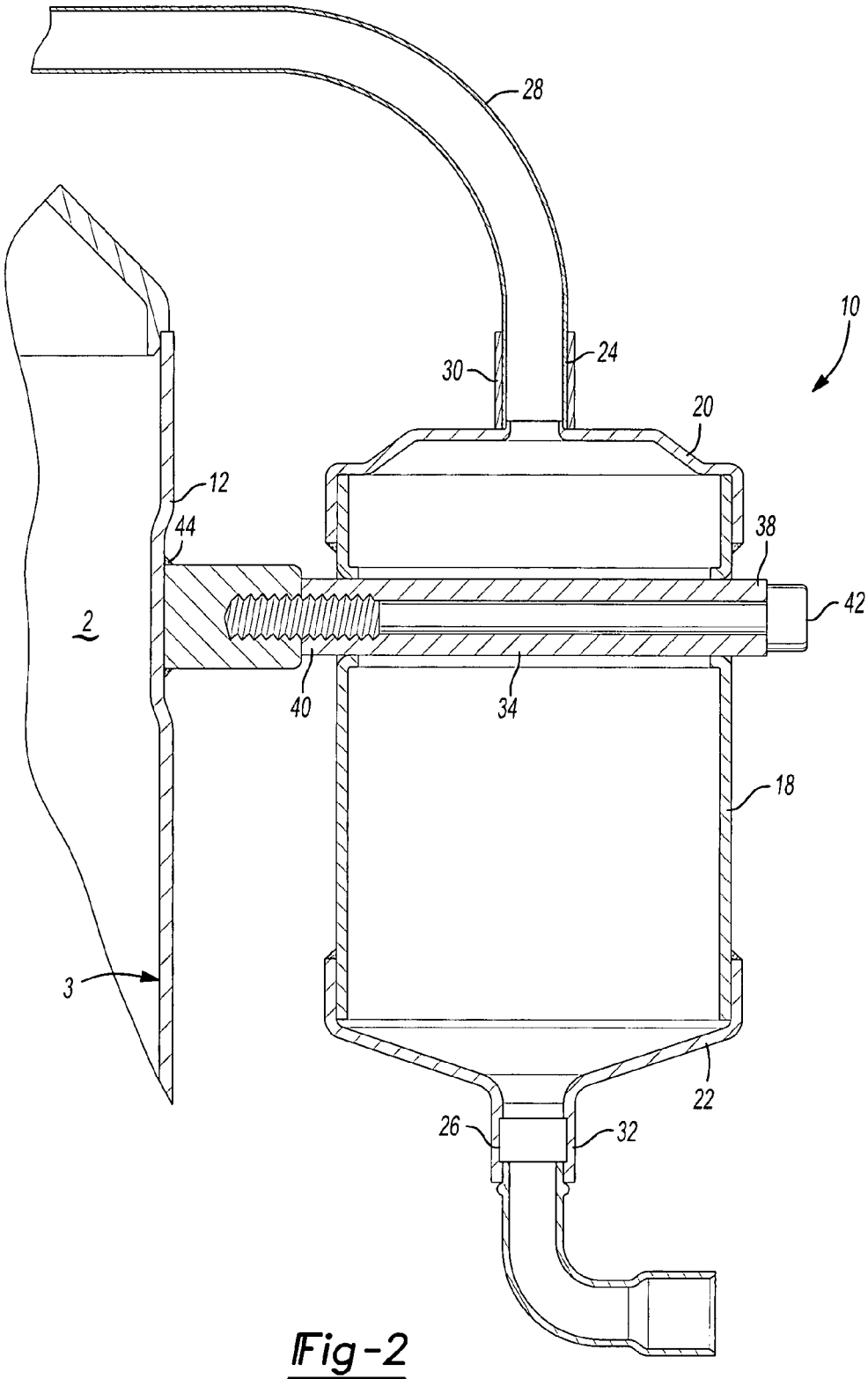
FIG. 2 is a cross-sectional view of a discharge muffler according to the present teachings.

Now referring to FIG. 2, the discharge muffler system 10 according to the present teachings will now be described. As shown in FIG. 2, the discharge muffler 10 is connected to an outer surface 12 of a compressor shell 3. The discharge muffler 10 includes a muffler housing 18 that is enclosed by a pair of end caps 20 and 22. The discharge muffler 10 is, generally, an external volume housing attached to the compressor shell 3. The upper cap 20 is formed at an inlet portion 24 of the muffler housing 18, while the lower end cap 22 is formed at a discharge end 26 of the muffler housing 18. Exhaust gases emitted by the compressor 2 travel through a discharge line 28 to the upper cap 20 at the inlet portion 24 of the discharge muffler 10. To connect the discharge line 28 to the upper cap 20 of the muffler housing 18, the upper cap 20 may include an inlet fitting 30 that may be brazed or welded to the upper cap 20. Alternatively, the inlet fitting 30 may be integral with the upper cap 20. This is exemplified by the lower cap 22 which includes an outlet fitting 32 which is integral with the lower cap 22.

The materials for the upper cap 20, lower cap 22, and muffler housing 18 may be any material known to one skilled in the art. Notwithstanding, it should be understood that preferable materials include steel or aluminum, or any other material that is strong and lightweight.

Figure 3:
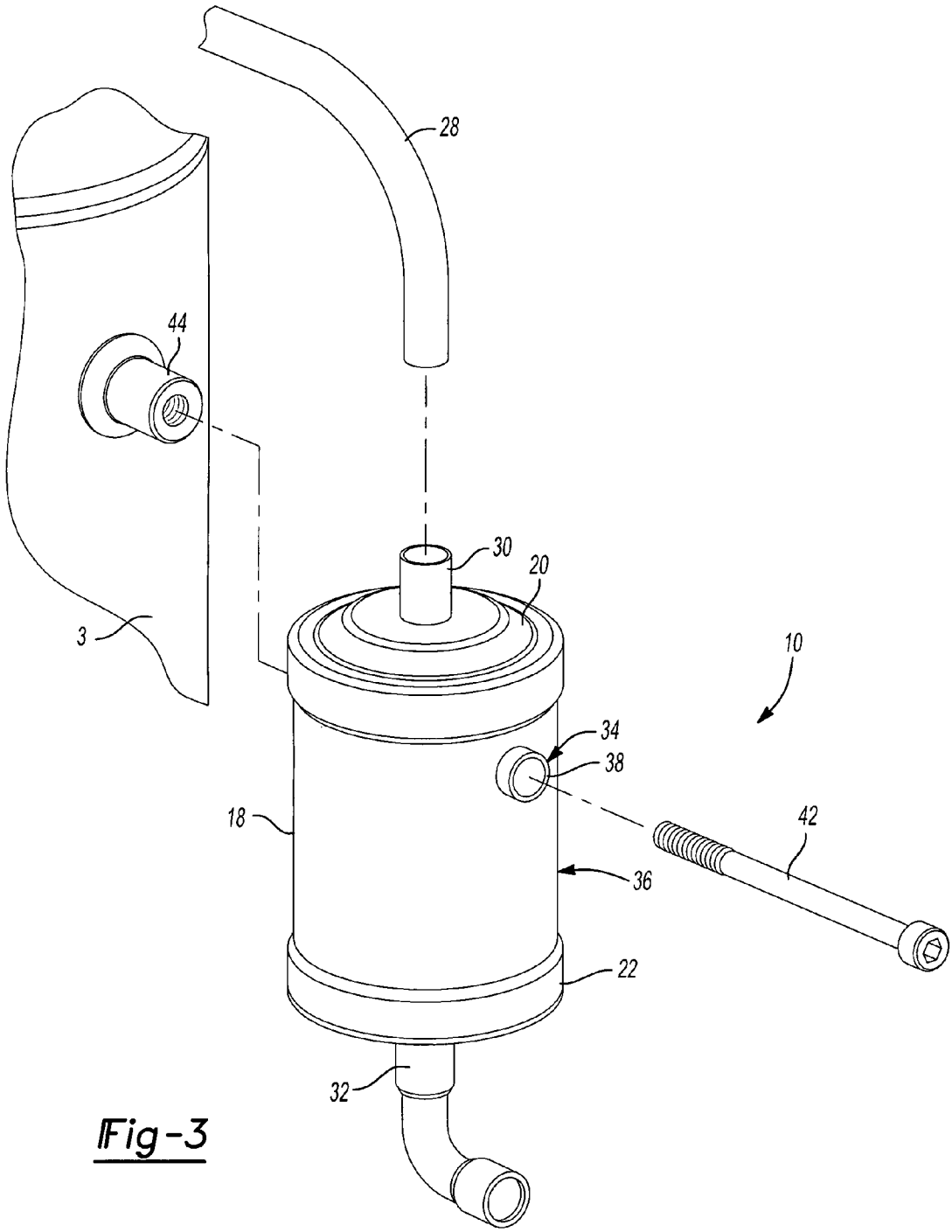
FIG. 3 is a exploded perspective view showing various components of the discharge muffler shown in FIG. 2.

To connect the discharge muffler 10 to the compressor shell 3, the discharge muffler 10 is provided with an internal sleeve or spacer 34. As best shown in FIG. 3, the spacer 34 is a, by way of non-limiting example, generally cylindrical shaped sleeve 34 that passes through a central portion 36 of the muffler housing 18. That is, the spacer 34 is disposed through the muffler housing 18 such that there is an entry portion 38 and an exit portion 40. To connect the spacer 34 to the muffler housing 18, the spacer 34 may be brazed or welded to the muffler housing 18.

The spacer 34 provides a pathway for a fastener 42, such as a bolt or screw, that fixes the discharge muffler 10 to the compressor shell 3. To fix the discharge muffler 10 to the compressor shell 3, the fastener 42 is coupled to a spud 44 which is fixedly attached to the compressor shell 3. The spud 44 may be attached to the compressor shell 3 by welding or brazing, or in any method known to one skilled in the art.

By mounting the discharge muffler 10 to the compressor shell 3 in this manner, the discharge muffler 10 is rigidly mounted to the compressor shell 3 in a manner such that vibrations are eliminated, or at least substantially minimized. That is, by utilizing a spacer 34 disposed through the central portion 36 of the muffler housing 18, a center of mass of the muffler 10 may be controlled, which in turn allows for vibrations of the muffler 10 to be eliminated, or at least substantially minimized. It should be understood, however, that the spacer 34 is not required to be disposed through a central portion 36 of the muffler housing 18 to control the center of mass of the muffler 10. That is, it is contemplated that the spacer 34 may be to an outer surface of the muffler housing 18 and still be within the scope of the present teachings.

Moreover, by mounting the discharge muffler 10 to the compressor shell 3 in this manner, the discharge line 28 needed to supply the exhaust gases from the compressor 2 into the discharge muffler 10 is kept at a minimal length. Accordingly, any refrigerant gas present in the discharge line 28, and in turn the discharge muffler 10, is kept to a minimum such that upon shutdown of the compressor 2 the discharge gas will not return through the discharge line 28 to the compressor 2 and run the scrolls 21 and 29 in reverse. Damage to the sensitive scroll components of the compressor 2, therefore, can be avoided.

Figure 4:
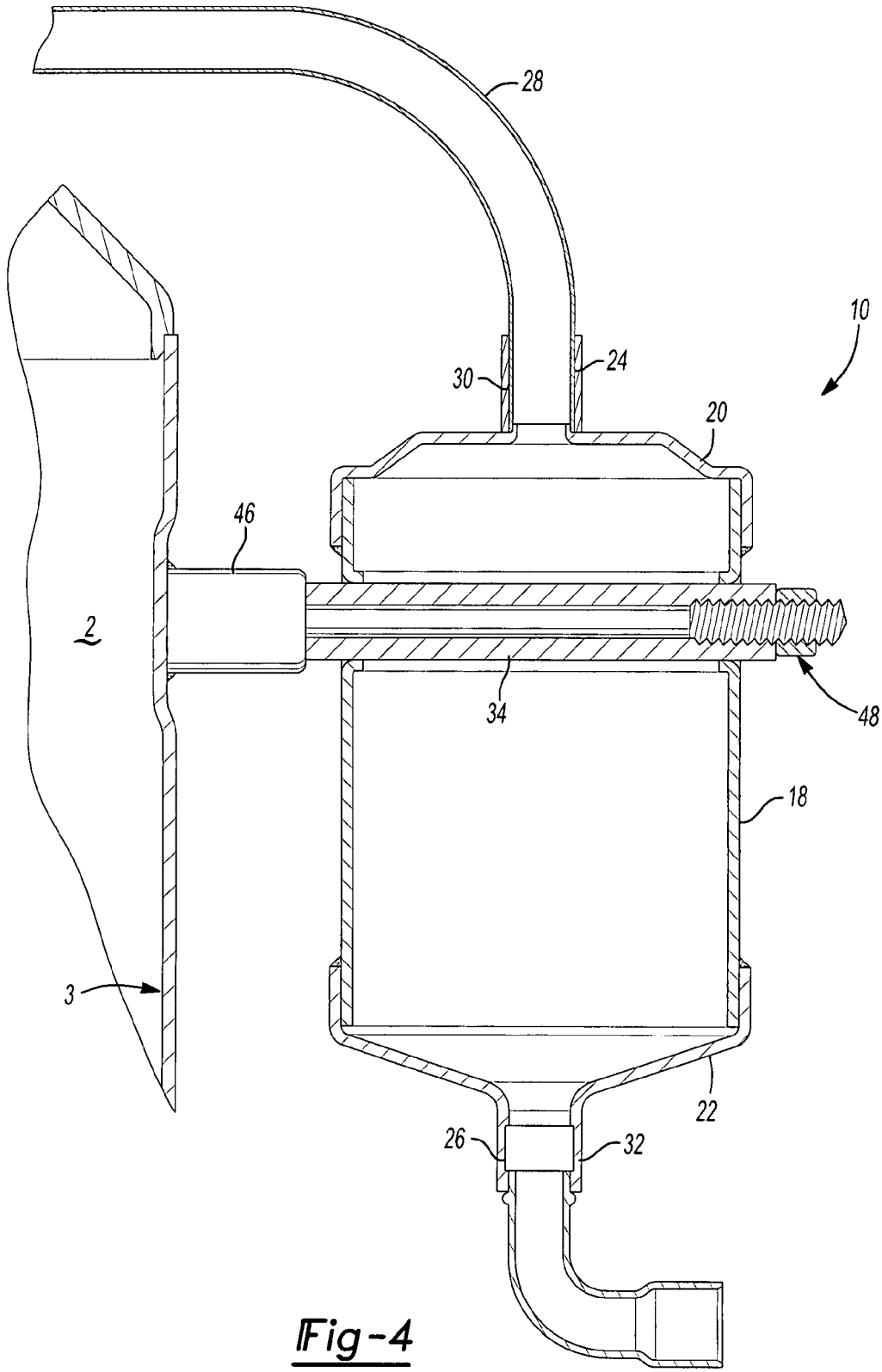
FIG. 4 is a cross-sectional view of a discharge muffler according to the present teachings.

Now referring to FIG. 4 another muffler 10 of the present teachings will be described. In FIG. 4, the through-mounted muffler 10 is connected to the compressor shell 3 via a threaded stud 46 that is welded or brazed to the compressor shell 3. The threaded stud 46 passes through the spacer 34 that is welded or brazed to the discharge muffler 10, and the discharge muffler 10 can be subsequently securely fastened to the compressor shell 3 by a nut 48 that is fastened to the threaded stud 46 where it exits the spacer 34 and muffler housing 18. Again, the discharge muffler 10 will be rigidly mounted to the compressor shell 3 to avoid vibrations of the discharge muffler 10 during operation of the compressor 2. Furthermore, since the length of the discharge muffler 10 is rigidly connected to the shell 3 of the compressor 2, the discharge line 28 between the inlet 24 of the muffler 10 and an outlet 35 of the compressor 2 will be minimized, thereby limiting the volume of discharge gas present in the discharge line 28 that may reenter the compressor 2 and run the scrolls 21 and 29 in reverse during shutdown.

Figure 5:
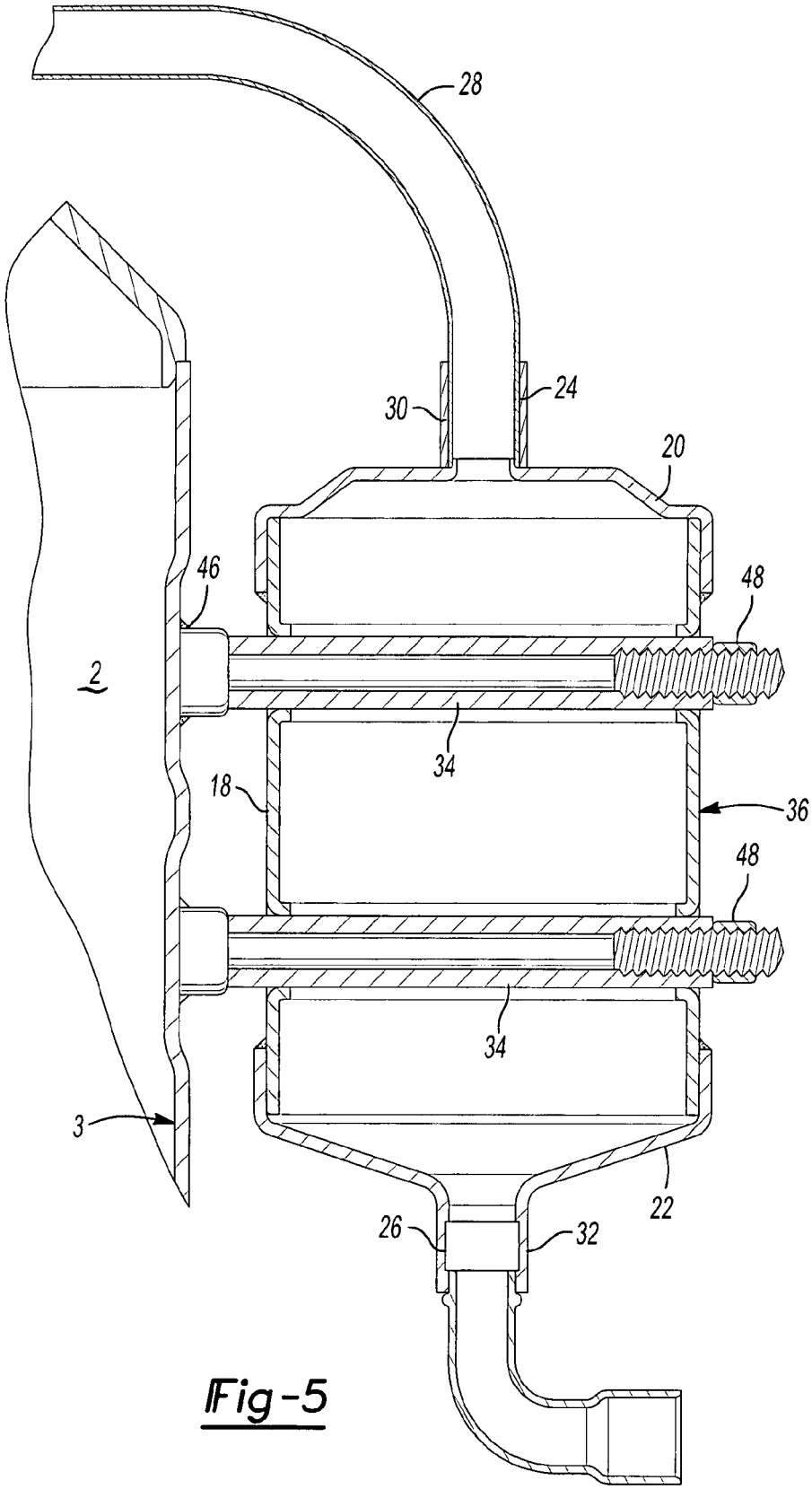
FIG. 5 is a cross-sectional view of a discharge muffler according to the present teachings.

Now referring to FIG. 5, the discharge muffler 10 is provided with a pair of spacers 34. Each of these spacers 34 is diametrically disposed through the central portion 36 of the discharge muffler 10, and adapted to receive a pair of threaded studs 46 that are welded to the compressor shell 3. Once the discharge muffler 10 has been mounted to the compressor shell 3, nuts 48 are placed at threaded ends of the studs 46 to securely fasten the discharge muffler 10 to the compressor shell 3. As a pair of spacers 34 and threaded studs 46 are used to secure the discharge muffler 10 to the compressor shell 3, the discharge muffler system 10 is more rigidly attached to the compressor shell 3 which further eliminates, or at least substantially minimizes vibrations experienced by the discharge muffler 10 during operation of the compressor 2. Further, the center of mass of the muffler 10 is further controlled to eliminate or at least suppress vibrations of the muffler 10. The discharge line 28 is also shortened by mounting the discharge muffler 10 to the compressor 2 in this manner.

Although threaded studs 46 are shown in FIG. 4, it should be understood that the pair of spacers 34 may also be adapted to receive a threaded fastener 42 like that shown in FIG. 1. Moreover, although the spacers 34 are described as being diametrically disposed through the housing 18 of the muffler 10, the spacers 34 are not required to be diametrically disposed through the muffler 10 so long as the center of mass of the muffler 10 is controlled.

Figure 6:
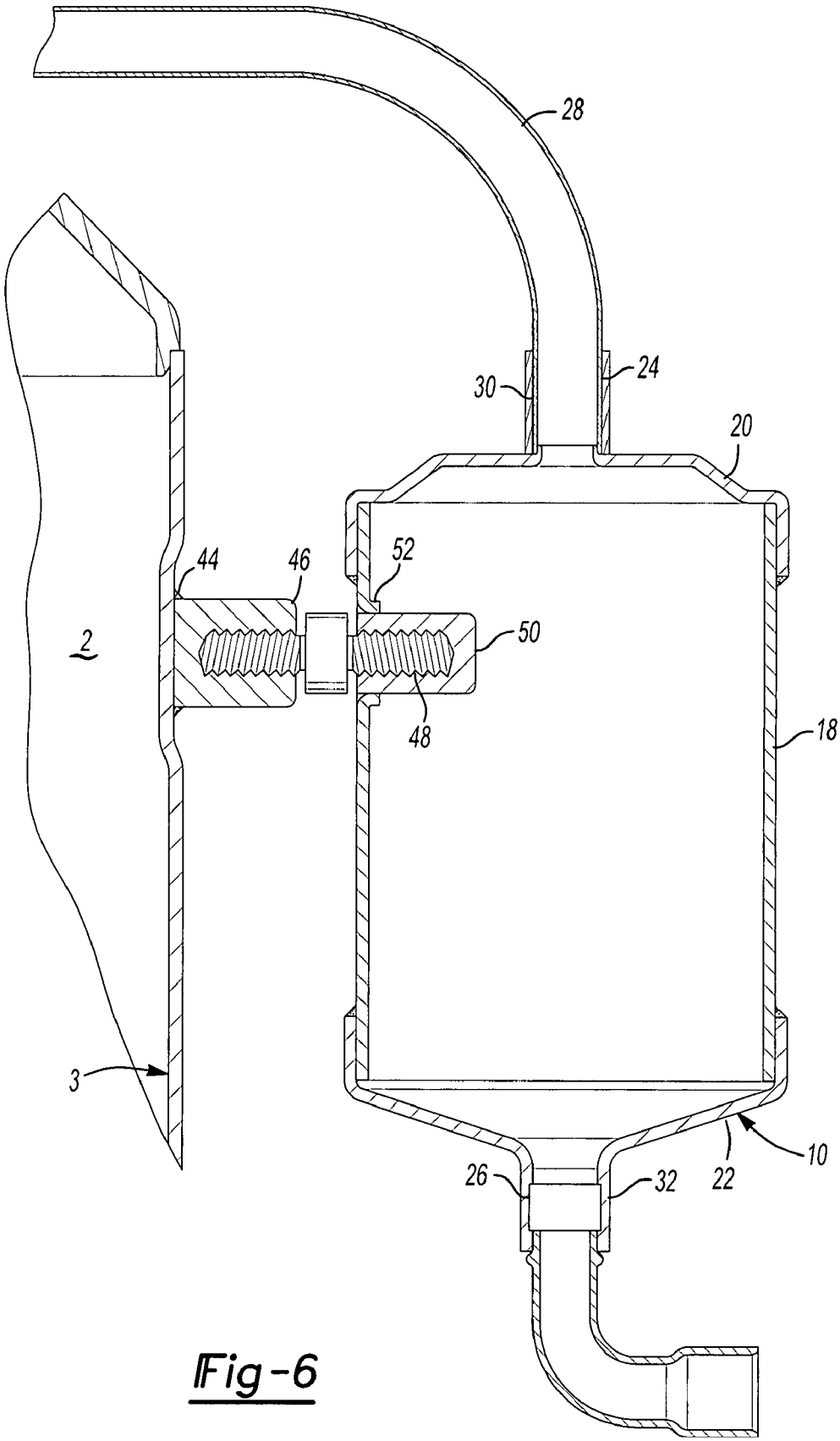
FIG. 6 is a cross-sectional view of a discharge muffler according to the present teachings.

Now referring to FIG. 6, another muffler 10 of the present teachings will be described. As shown in FIG. 6, the discharge muffler 10 is mounted to the compressor shell 3 by a double threaded stud 48 that engages with a spud 44 connected to the compressor shell 3 and a spud 50 mounted to an outer portion 52 of the muffler housing 18. The spuds 44 and 50 are mounted to the compressor shell 3 and discharge muffler housing 18 by brazing, welding, or the like.

Although the spud 50 mounted to the muffler housing 18 is shown to extend into the muffler housing 18, the present teachings should not be limited thereto. In contrast, the spud 50 may extend outward from the muffler housing 18 in a manner similar to that of the spud 44 connected to the compressor shell 3. Regardless, so long as the muffler 10 is rigidly attached to the compressor shell 3 such that minimal vibrations are experienced by the muffler 10 during operation of the compressor 2, any configuration for the spud 50 connected to the muffler housing 18 is sufficient.

Figure 7:
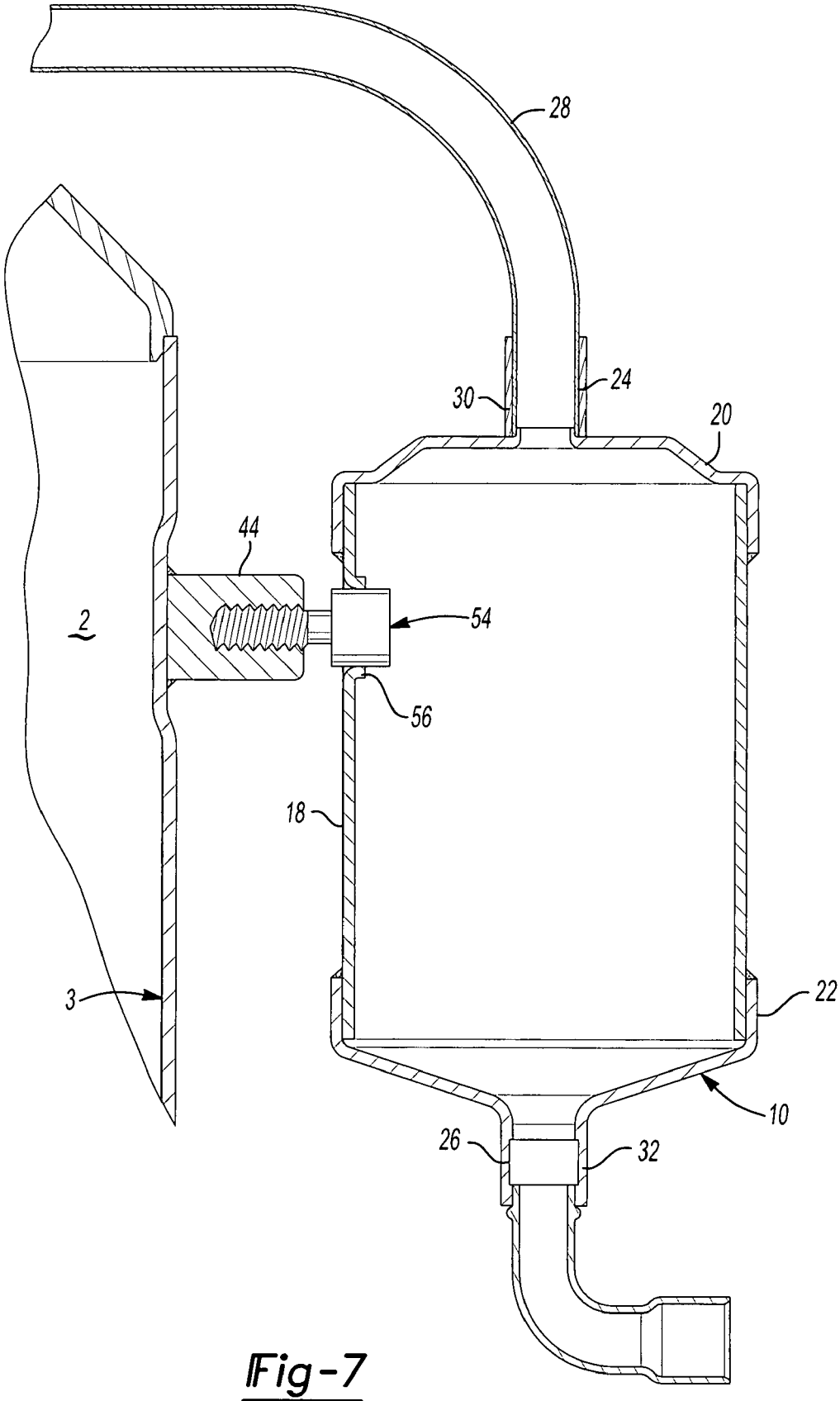
FIG. 7 is a cross-sectional view of a discharge muffler according to the present teachings.

Now referring to FIG. 7, the discharge muffler 10 is provided with a threaded stud 54 that is attached to the discharge muffler housing 18. In this regard, the discharge muffler housing 18 includes a through-hole 56 that may be provided with a threading (not shown) that corresponds to a threading formed on the stud 54. Accordingly, the stud 54 may be easily screwed into the discharge muffler housing 18, and subsequently attached to a spud 44 that is welded to the compressor shell 3.

Figure 8:
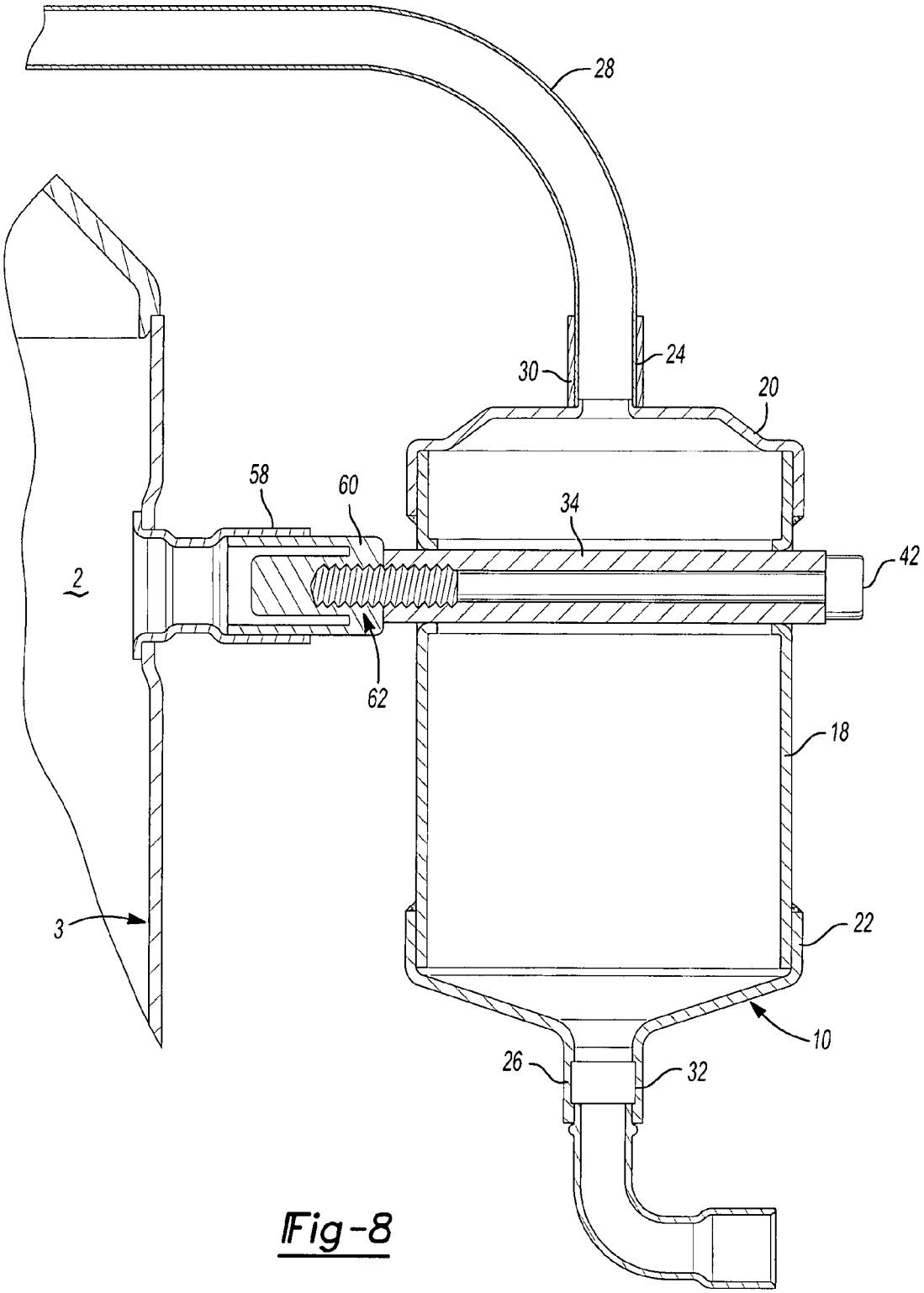
FIG. 8 is a cross-sectional view of a discharge muffler according to the present teachings.

Now referring to FIG. 8, the compressor shell 3 may be provided with a suction fitting 58. Suction fittings are generally used in the art to couple a fluid source to a suction inlet portion of the compressor 2. To connect the discharge muffler 10 to the suction fitting 58, the muffler 10 may be provided with a spacer 34 that is diametrically disposed through a center 36 of the discharge muffler housing 18. At a connection end 60 of the spacer 34 is a fitting 62 that is adapted to be received by the suction fitting 58. To rigidly connect the spacer 34 fitting to the suction fitting 58, the spacer fitting 62 may be brazed or welded to the suction fitting 58 formed on the compressor shell 3, or be adapted to accommodate a fastener 42. These components are readily available and may be easily adapted to existing compressors.

Figure 9:
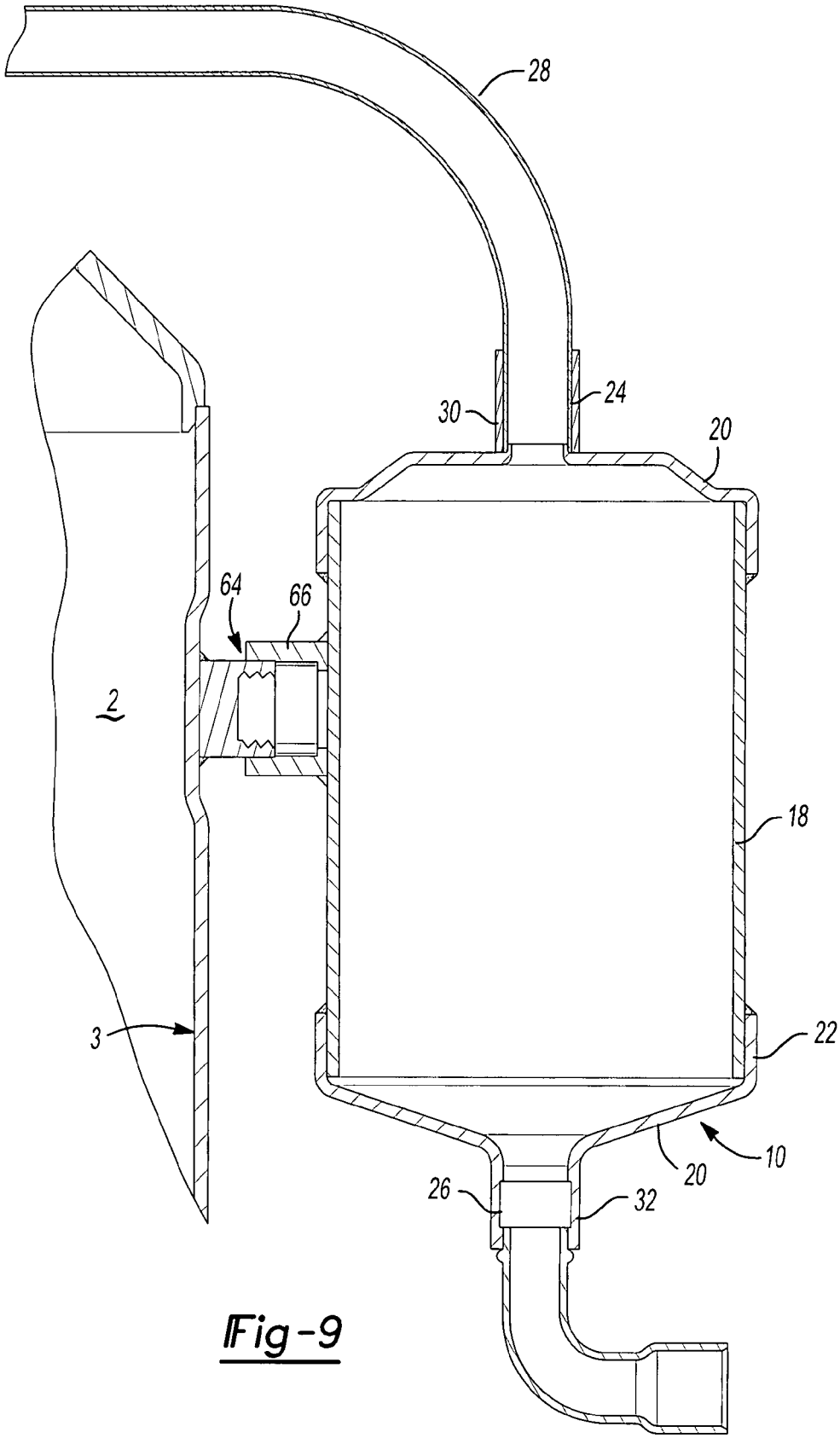
FIG. 9 is a cross-sectional view of a discharge muffler according to the present teachings.

Referring to FIG. 9, the compressor shell 3 is provided with a fitting 64 having a thread (not shown), such as a pipe thread. Coupled to the compressor fitting 64 is another fitting 66 welded or brazed to an outer surface of the muffler housing 18. The fitting 66 attached to the outer surface of the muffler housing 18 has a thread (not shown) that corresponds to the thread of the compressor shell fitting 64. In this manner, the muffler 10 threads directly onto the compressor fitting 64 to rigidly connect to the compressor shell 3 such that vibrations are eliminated, or at least substantially minimized.

Figure 10:
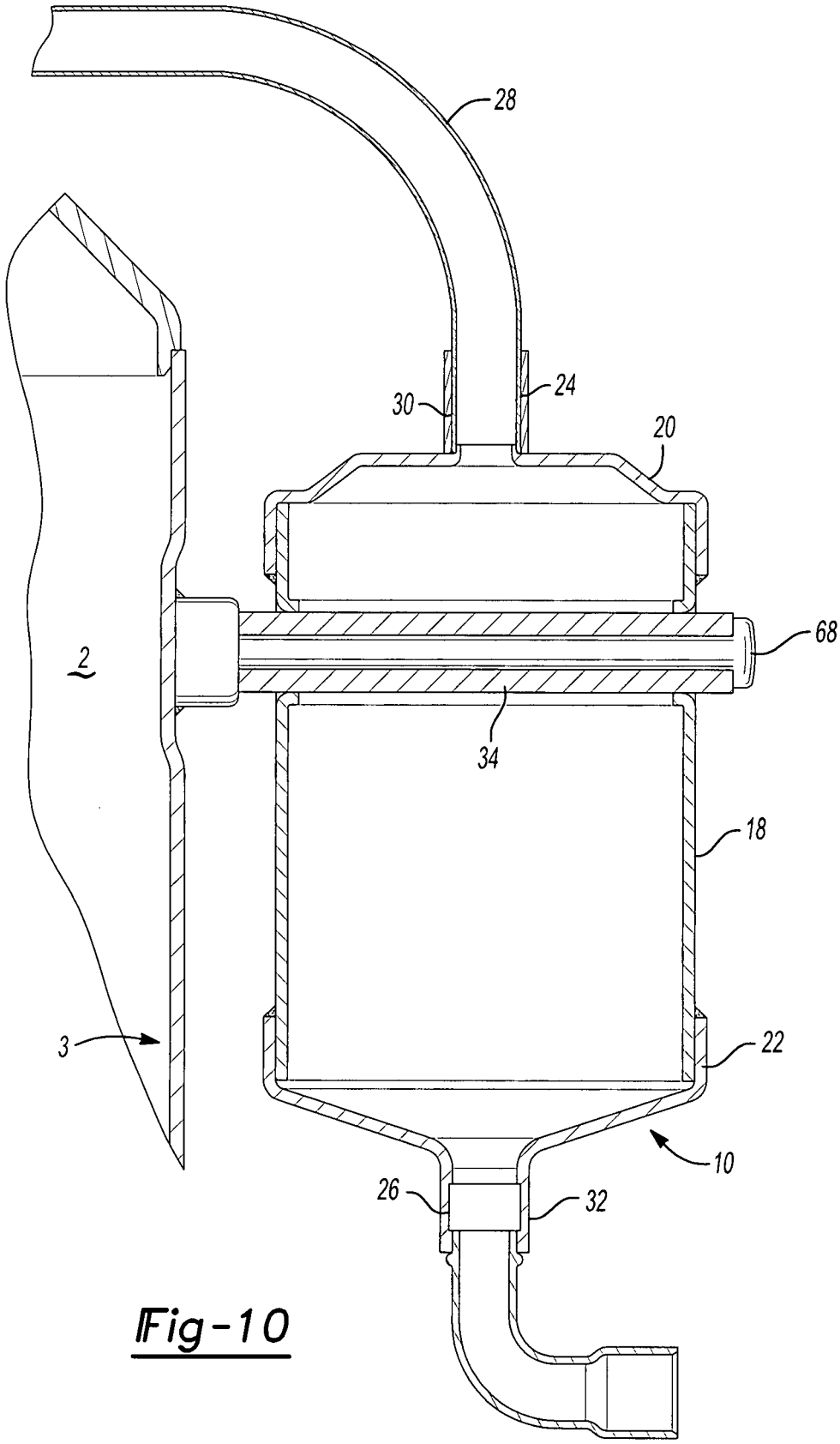
FIG. 10 is a cross-sectional view of a discharge muffler according to the present teachings.
Figure 11:
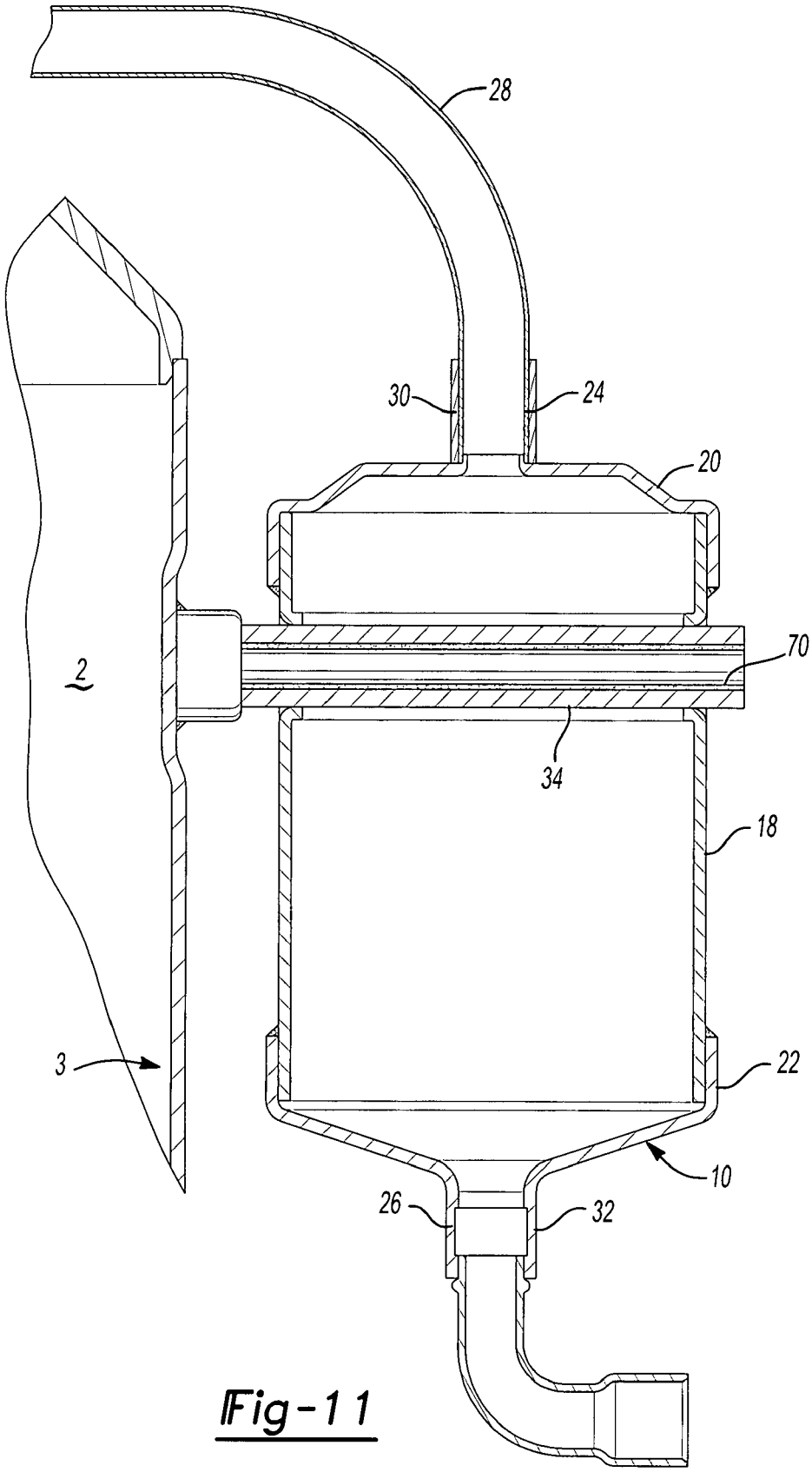
FIG. 11 is a cross-sectional view of a discharge muffler according to the present teachings.
Figure 12:
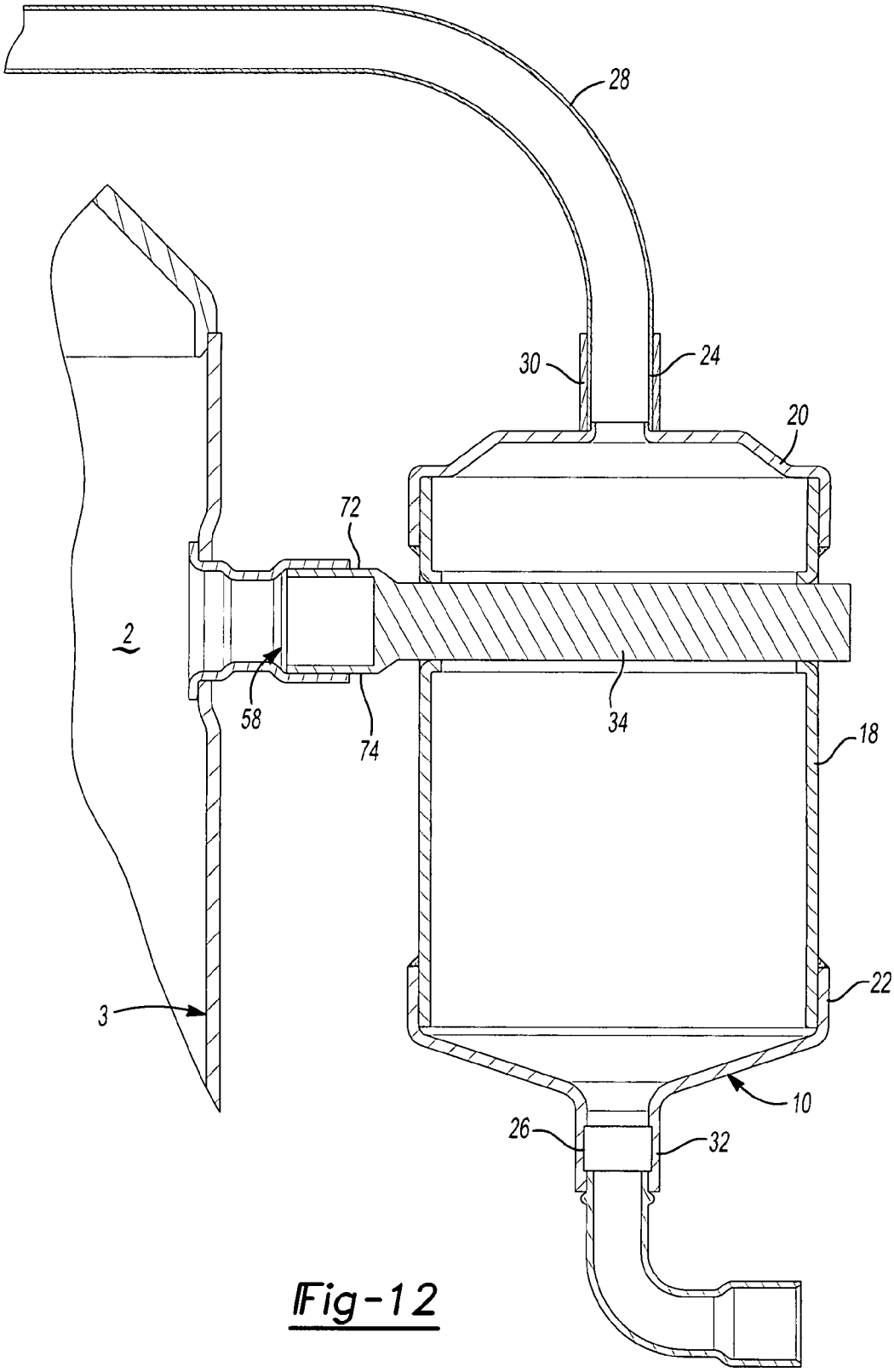
FIG. 12 is a cross-sectional view of a discharge muffler according to the present teachings.

As another configuration, shown in FIG. 10, the discharge muffler 10 having the spacer 34 diametrically disposed therein may be adapted to receive a rivet 68 that in turn is welded or brazed to the compressor shell 3. Alternatively, as shown in FIG. 11, the spacer 34 may be adapted to receive a stud 70 that may be press fit or adhesively attached to the spacer 34. Now referring to FIG. 12, the discharge muffler 10 is fitted with a solid spacer 34. At an end 72 of the spacer 34 that is to be attached to the compressor shell 3, the spacer 34 is provided with a fitting 74 that corresponds a suction fitting 58 that is brazed or welded to the compressor shell 3. Regardless, with each of the above configurations, it should be understood that the discharge muffler 10 is rigidly connected to the compressor shell 3 such that vibrations during compressor operation are eliminated, or at least substantially minimized.

Figure 13:
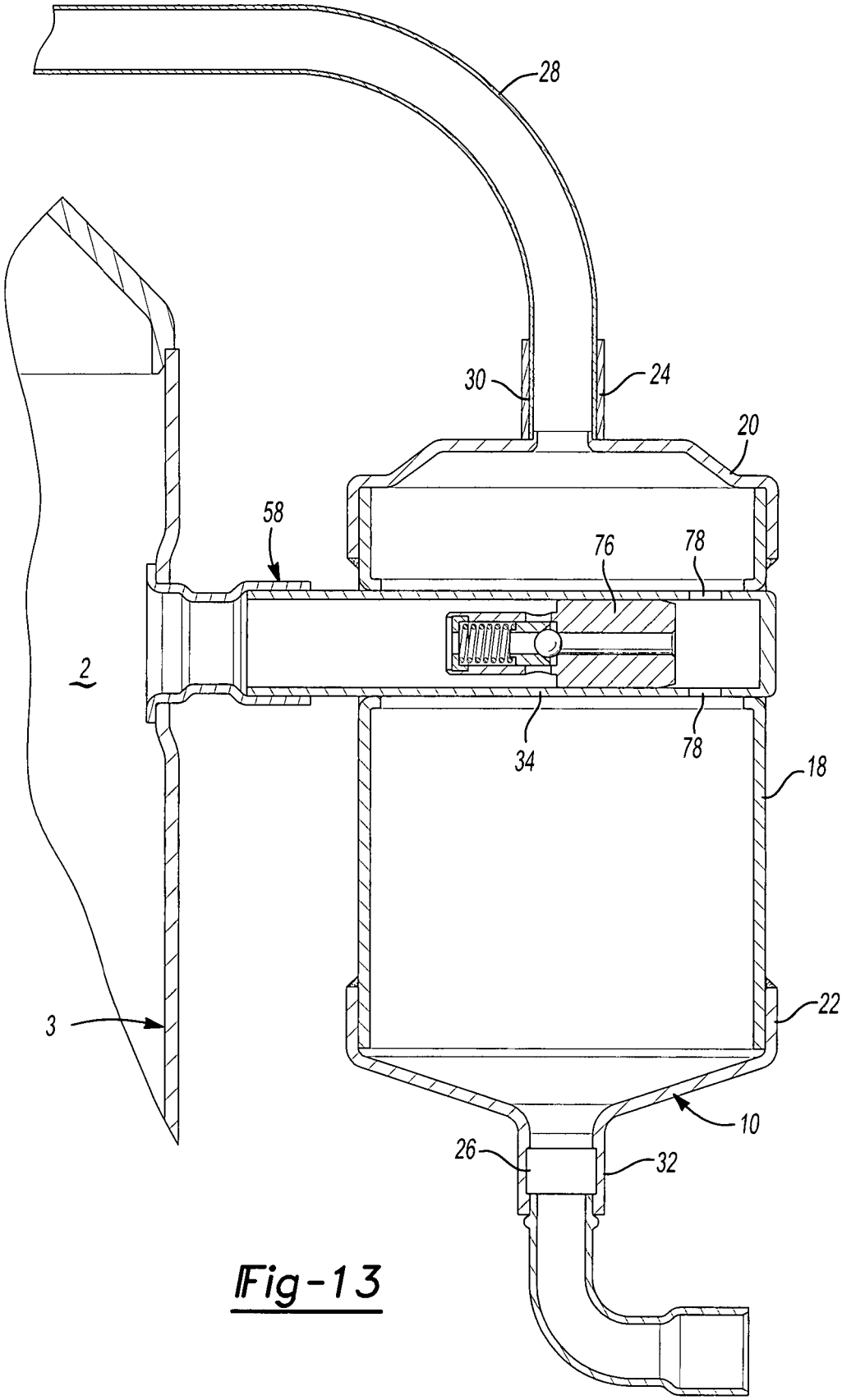
FIG. 13 is a cross-sectional view of a discharge muffler including a pressure-protection device according to the present teachings.

In addition to avoiding or substantially minimizing the vibrations experienced by the discharge muffler 10, the through-mounted discharge muffler 10 of the present teachings has other advantages. In particular, referring to FIG. 13, the through-mounted discharge muffler 10 may be provided with a hollow spacer 34 that is adapted to house a sensor device that assists in detecting changes in temperature- or pressure-related conditions of the compressor 2 during operation. In particular, as shown in FIG. 13, the compressor shell 3 is provided with a suction fitting 58 that connects with the hollow spacer 34 to allow fluid communication between the discharge muffler 10 and a suction section of the compressor 2. Because the spacer 34 is provided with a valve 76 (here a pressure valve) that may be actuated by changes in temperature- or pressure-related conditions within the muffler 10, the compressor 2 is provided with protection options that protect the components of the compressor 2.

To allow the exhaust gases to fluidly communicate between the muffler 10 and suction portion of the compressor 2, the spacer 34 is provided with inlet ports 78. The inlet ports 78 allow the discharge gases to enter the spacer 34 and contact the components of the valve 76. If the conditions of the discharge gas are such that a pressure or temperature of the discharge gas is too high, the valve 76 will open and allow discharge gas to enter the suction portion of the compressor 2. Within the suction portion of the compressor 2, a sensor 77 is present that will trip and cause the compressor 2 to shut down.

Figure 14A:
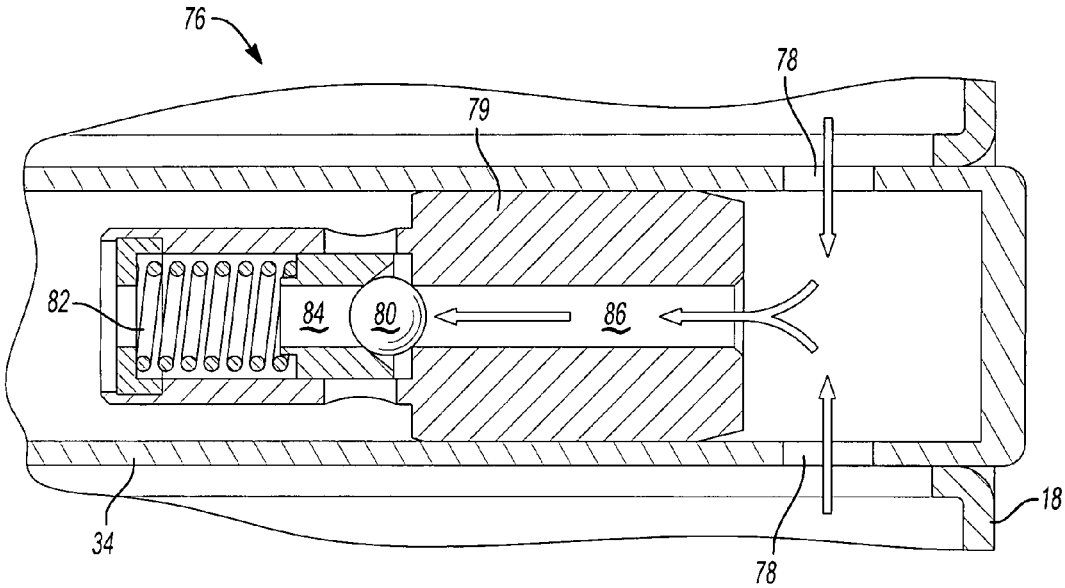
FIGS. 14A and 14B are cross-sectional views of the pressure-protection device in an closed and open state, respectively.
Figure 14B:
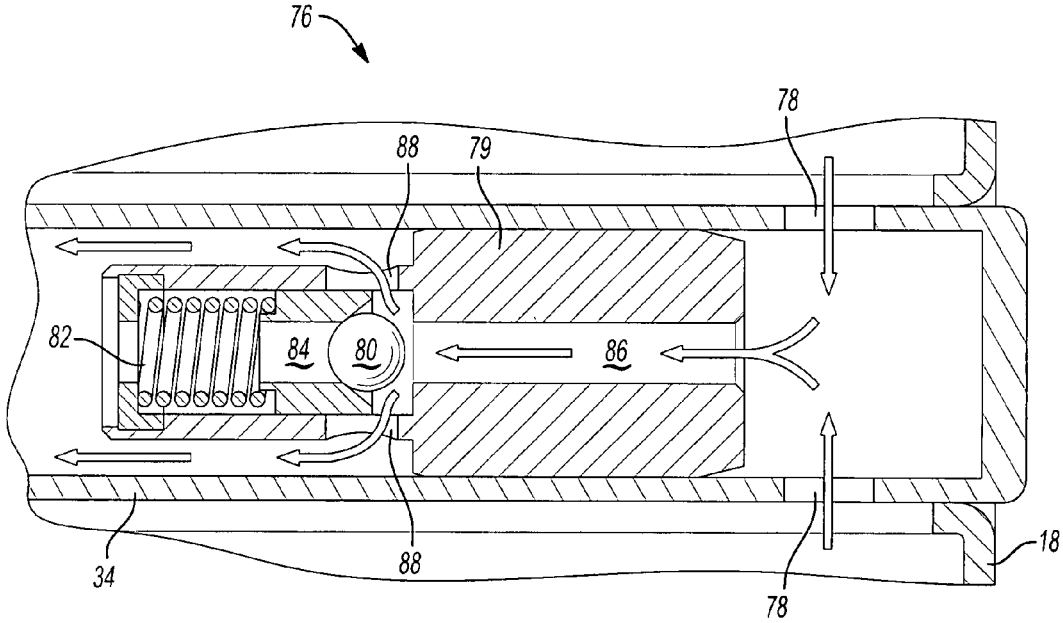

More particularly, referring to FIGS. 14*a* and 14*b*, the pressure valve 76 accommodated within the muffler 10 of the present teachings is shown in a closed and open state, respectively. As shown in FIG. 14*a*, the pressure valve 76 is comprised of a monolithic valve housing 79 that supports a ball 80 and spring 82. The ball 80 is attached or supported by a plunger 84 which in turn is coupled to the spring 82.

As discharge gas within the muffler 10 enters the spacer 34 through the ports 78, it is also able to enter the valve housing 79 through a conduit 86 in the valve housing 79. If the pressure of the discharge gas is at a predetermined level (i.e., a high enough pressure to overcome the spring coefficient of the spring 82) within the muffler, the spring 82 will compress such that the ball 80 attached or supported by the plunger 84 will open a fluid path 88 between the valve housing 79, ball 80, and suction portion of the compressor 2 to allow the discharge gas to flow through the valve 76 into the suction portion of the compressor 2 as shown by the arrows (FIG. 14*b*). This flow causes the suction gas to heat up because the exhaust gases have not had sufficient time to cool after being expelled by the compressor 2 into the discharge muffler 10. This heating effect will cause the motor protector 77 to trip and cause the compressor 2 to shut down. It should be understood that the predetermined pressure can be determined based on a pressure within the muffler 10 or a pressure differential between the muffler 10 and the compressor shell 3.

After the pressure differential returns to a normal running condition, the valve 76 will reset and the flow path 88 to the suction portion of the compressor 2 will close. The resetting of the valve 76 preferably occurs prior to the resetting of the motor protector 77. Although the pressure protection preferably includes a ball 80 and spring 82 pressure valve 76 as shown, it should be understood that any device that is actuatable upon a change in pressure differential may be used with the present teachings without departing from the spirit and scope of the present teachings. Further, depending on the desired operating conditions of the compressor 2, the pressure relief valve 76 may be designed to accommodate a plurality of different pressures. In this regard, the spring 82 may be selected according to different spring coefficients that enable the tripping of the pressure relief valve 76 to engage and disengage depending on various operating conditions.

Figure 15:
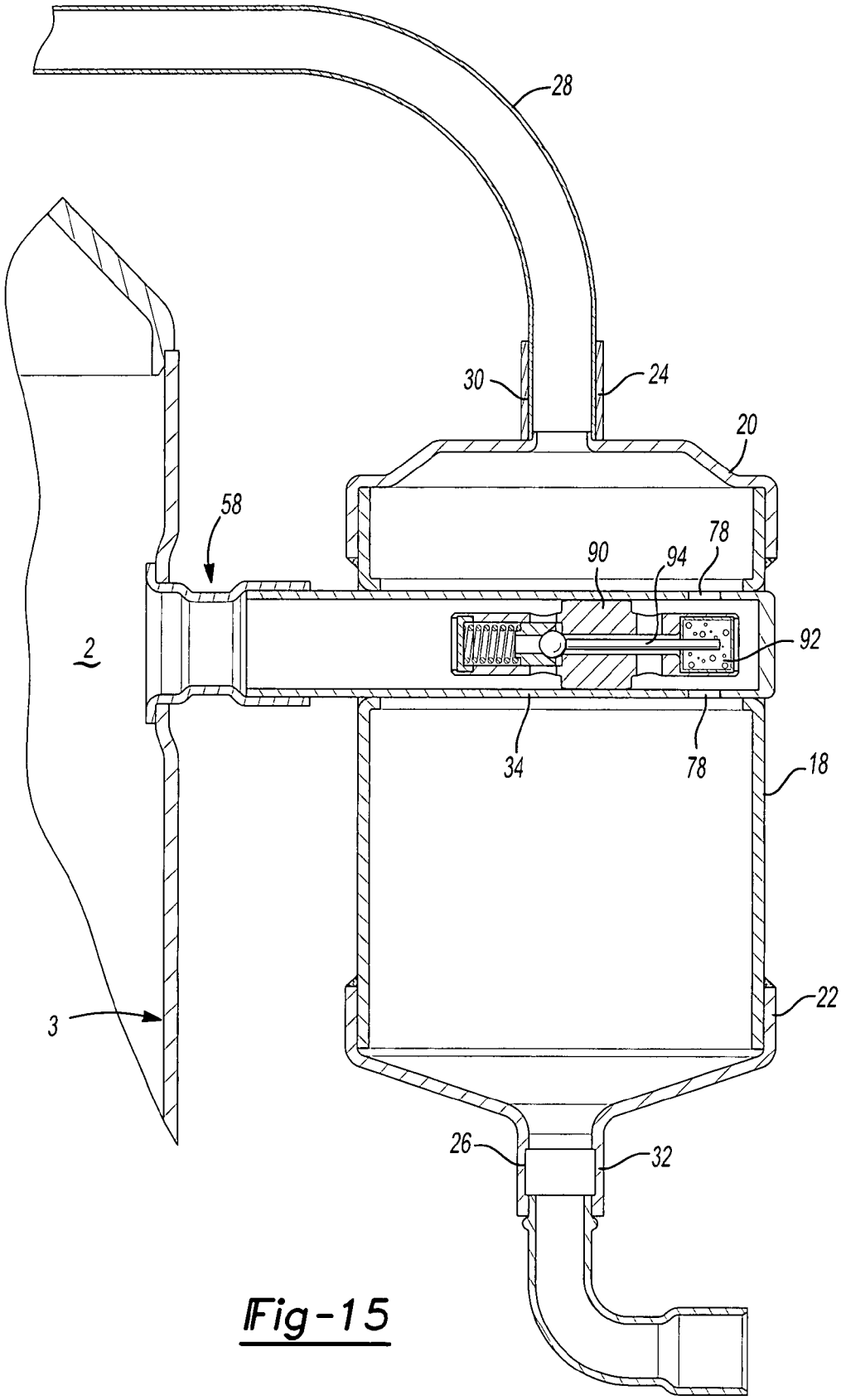
FIG. 15 is a cross-sectional view of a discharge muffler including a temperature-protection device according to the present teachings.
Figure 16A:
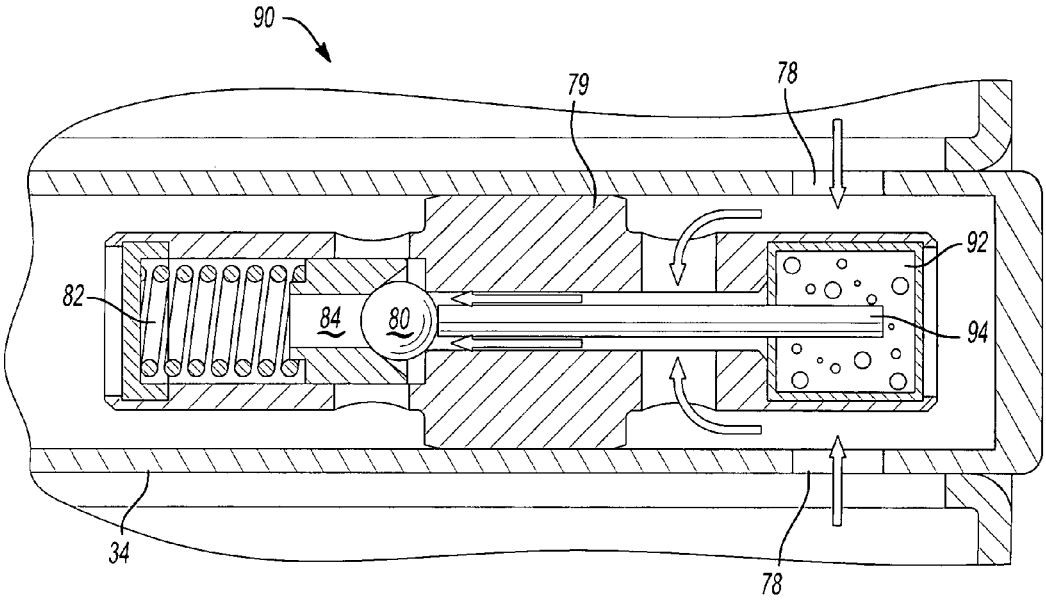
FIGS. 16A and 16B are cross-sectional views of the temperature-protection device in an closed and open state, respectively.
Figure 16B:
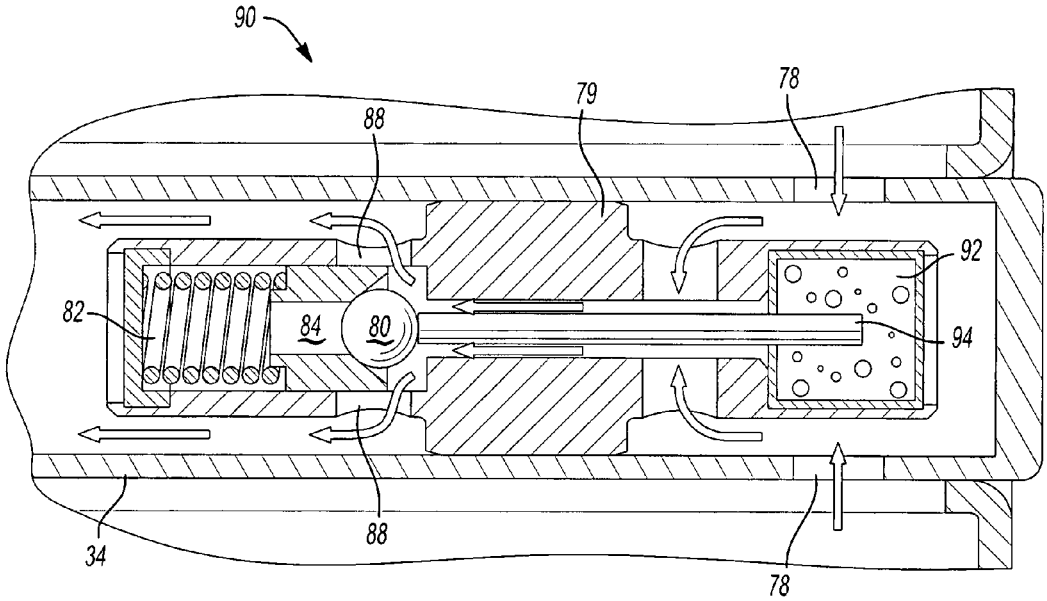

Now referring to FIGS. 15, 16*a* and 16*b*, the temperature protection options according to the present teachings will be described. As shown in FIG. 15, the spacer 34 provided in the through mounted discharge muffler 10 houses a temperature protection valve 90. Similar to the muffler configuration housing the pressure relief valve 76, the spacer 34 housing the temperature protection valve 90 is fitted to a shell fitting 58 that returns the discharge gas to a suction portion of the compressor 2.

Now referring to FIGS. 16*a* and 16*b*, operation of the temperature relief valve 90 will be described. The temperature relief valve 90 is similar to the pressure relief valve 76 in that the valve 90 includes a valve housing 79, a spring 82, and a ball 80 connected or supported by a plunger 84, wherein the plunger 84 is coupled to the spring 82. As shown in FIG. 16*a*, however, the valve 90 further includes a temperature sensitive device 92 that may actuate compression of the spring 82.

The temperature sensitive device 92 may be a thermally expanding material that expands and contracts at predetermined temperatures. When the material expands, it actuates a plunger 94 that presses against the ball 80 in a manner to compress the spring 82 and open flow paths 88 around the ball (FIG. 16*b*). In this manner, the discharge gas is allowed to travel through the valve 90 and into the suction portion of the compressor 2 as shown by the arrows. Because the discharge gas has a temperature sufficient to trip the temperature detection system, the exhaust gas will enter the suction portion of the compressor 2 at a temperature that is sufficient to trip the motor protector 77 and cause the compressor 2 to shut down. After the temperatures returns to a predetermined amount which is set by the type of thermally expandable material used in the valve 90, the valve 90 will reset and the flow path 88 to the suction portion of the compressor 2 will close. The resetting of the valve 90 may occur prior to the resetting of the motor protector 77. Although a thermally expanding material is shown and described, it should be understood that the present teachings should not be limited thereto. Alternatively, a thermal disk that opens and closes at predetermined temperatures may be used without departing from the spirit and scope of the present teachings.

Figure 17:
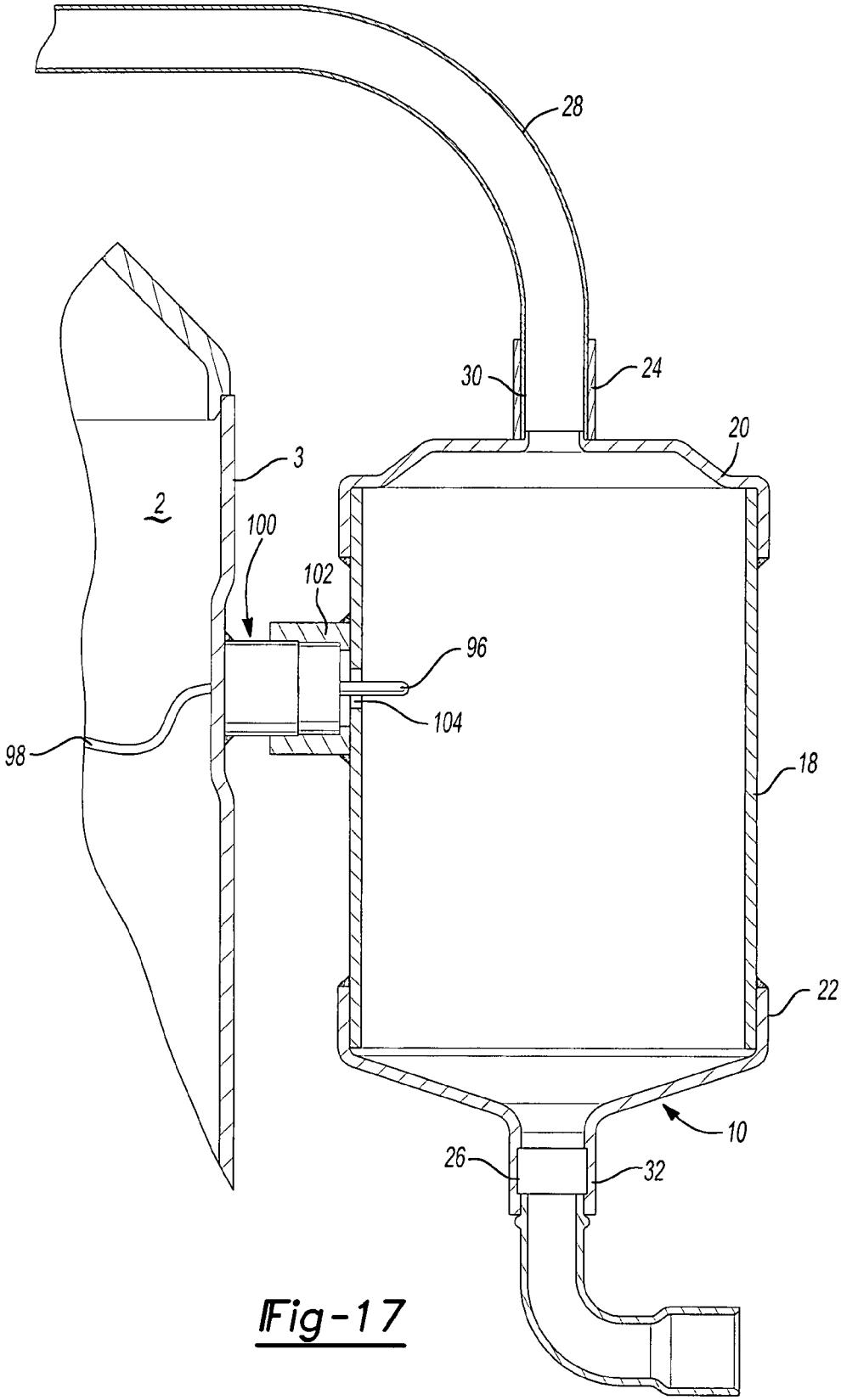
FIG. 17 is a cross-sectional view of a discharge muffler including a temperature-protection device according to the present teachings.

As shown in the described configuration, a ball 80 and spring 82 temperature sensing valve 90 was used. It should be understood, however, that any such device that activates thermally should be considered as an option for the present teachings. For example, as shown in FIG. 17, a temperature probe 96 that is wired by a connection 98 to the motor protector 77 can be used in place of the temperature sensing valve 90. The probe 96 is provided on a shell fitting 100 that may be threadingly coupled to a fitting 102 provided on a surface of the muffler housing 18. The probe 96 extends into the muffler housing 18 through a hole 104 in the muffler housing 18. In this manner, if a temperature of the discharge gas within the muffler housing 18 is too high, the probe 96 will send a signal to the motor protector 77 to shut down the compressor 2.

Figure 18:
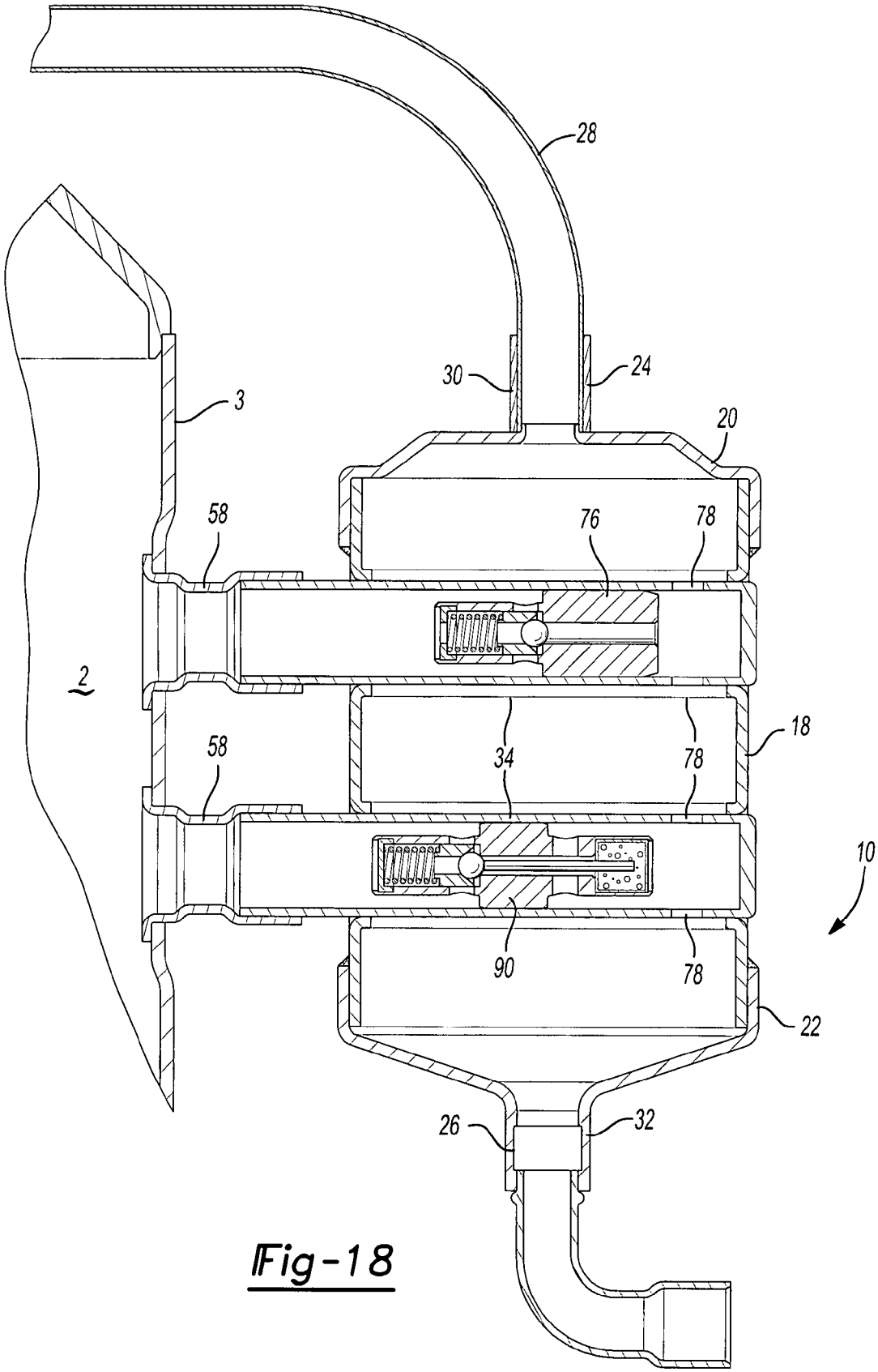
FIG. 18 is a cross-sectional view of a discharge muffler including a pressure-protection device and a temperature-protection device according to the present teachings.

Now referring to FIG. 18, the through mounted discharge muffler 10 includes a pair of spacers 34 housing a pressure protection valve 76 and a temperature protection valve 90, respectively. In this manner, the compressor 2 of the present teachings may include both the pressure relief as well as the temperature relief options.

Figure 19:
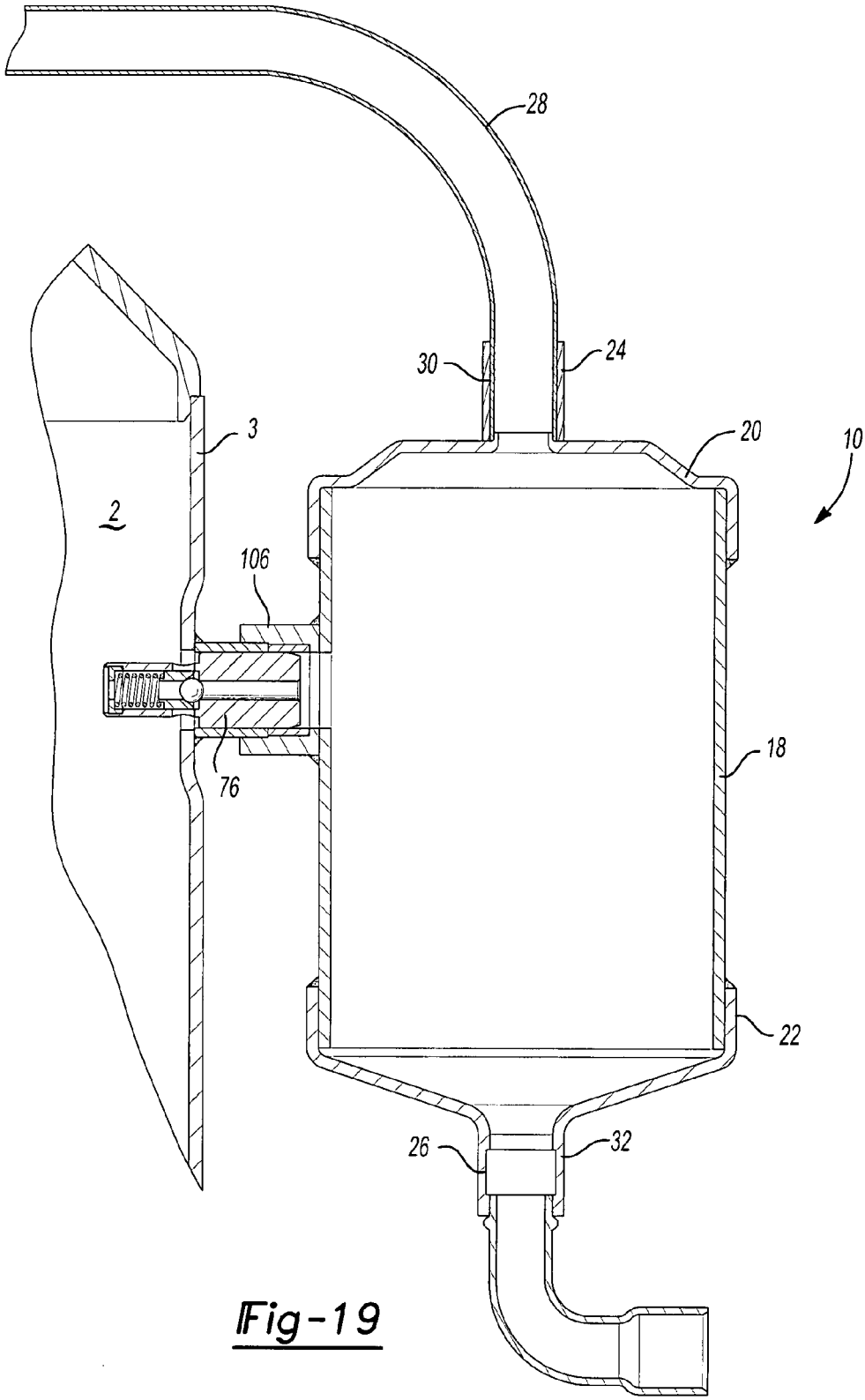
FIG. 19 is a cross-sectional view of a discharge muffler including a pressure-protection device according to the present teachings.
Figure 20:
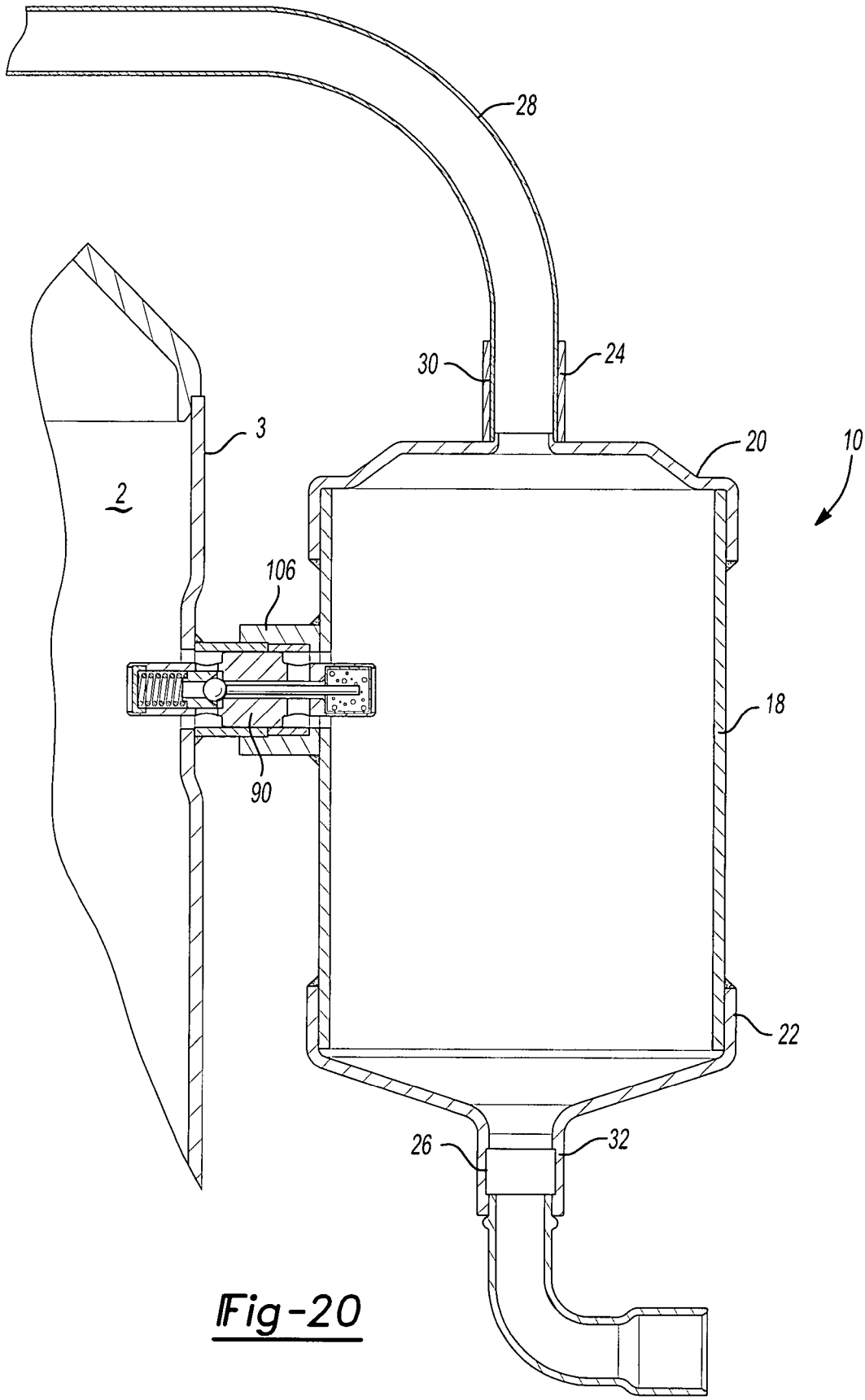
FIG. 20 is a cross-sectional view of a discharge muffler including a temperature-protection device according to the present teachings.

Now referring to FIGS. 19 and 20, the discharge muffler 10 may be mounted with a fitting 106 that is adapted to accommodate either the pressure relief or temperature relief valves 76 and 90 described above. As the discharge gas enters the discharge muffler 10, it will contact the pressure relief or temperature relief devices in these valves, and if a sufficient pressure of temperature is achieved the ball 80 and spring 82 valve will trip and allow discharge gas to enter the suction portion of the compressor 2. If the temperature of the gas or pressure of the gas it too high, the elevated temperature gas within the suction portion of the compressor 2 will cause sensor 77 to trip and shut down the compressor 2.

It should be understood that although the above configurations have been described above relative to use in a scroll compressor to prevent backflow of exhaust gases into the compressor that may reverse the scrolls, the present teachings should not be limited to a scroll compressor. In contrast, the mufflers described above can be configured and adapted to operate with any type of compressor known to one skilled in the art, including rotary, rotating, orbiting, and reciprocating types. Further, although the present teachings have been described relative to an externally mounted discharge muffler, the discharge muffler can be adapted to be disposed within the compressor shell without departing from the spirit and scope of the present teachings.

What is claimed is:

1. A compressor comprising:

a shell defining an interior space and an exterior space, the shell having a discharge outlet;

a fitting fixed to said shell and positioned at a separate location from the discharge outlet;

a compressor mechanism disposed within said interior space defined by said shell;

a drive member driving said compression mechanism;

a discharge muffler disposed in said exterior space defined by said shell, said discharge muffler having a discharge muffler inlet in communication with the discharge outlet and a discharge muffler outlet defining a flow path between said discharge muffler inlet and said discharge muffler outlet; and at least one spacer disposed through said discharge muffler in a direction transverse to said flow path, and said spacer received within said fitting.

2. The compressor of claim 1, wherein said discharge muffler inlet and said discharge muffler outlet define an axis of said discharge muffler, and said spacer is disposed through said discharge muffler transverse to said axis.

3. The compressor of claim 1, further comprising a plurality of spacers disposed through said discharge muffler.

4. The compressor of claim 1, wherein said fitting is a suction fitting and said spacer fits within said suction fitting.

5. The compressor of claim 1, wherein said fitting includes a fastener press fit within said spacer.

6. The compressor of claim 1, wherein said fitting includes a fastener adhered to said spacer.

7. The compressor of claim 1, further comprising a protection device within said discharge muffler.

8. The compressor of claim 7, wherein said protection device is disposed within said spacer.

9. The compressor of claim 7, wherein said protection device is a pressure-relief valve actuated upon a pressure within said muffler reaching a predetermined level.

10. The compressor of claim 7, wherein said protection device is a pressure-relief valve actuated upon a predetermined differential pressure level between said muffler and said shell.

11. The compressor of claim 7, wherein said protection device is actuated upon a temperature within said muffler reaching a predetermined level.

12. The compressor of claim 7, wherein said at least one spacer includes a first spacer housing a temperature-protection device and a second spacer housing a pressure-protection device.

13. The compressor of claim 1, wherein said discharge muffler is mounted to said housing shell by said spacer at an approximately central portion of said discharge muffler.

14. The compressor of claim 13, wherein said spacer is disposed through said approximately central portion of said discharge muffler.

15. The compressor of claim 1, wherein said compression mechanism is selected from the group comprising: rotary, rotating, orbiting, and reciprocating compression mechanisms.

16. The compressor of claim 1, wherein said compression mechanism includes a first scroll member having a first spiral wrap, a second scroll member having a second spiral wrap intermeshed with said first spiral wrap of said first scroll member, and said drive member causes said first and second scroll members to orbit relative to one another.

17. The compressor of claim 1, wherein said discharge muffler includes a housing, and said spacer is disposed entirely through said housing.

18. A compressor comprising:

a shell defining an interior space and an exterior space, the shell having a discharge outlet;

a fitting fixed to said shell and positioned at a separate location from the discharge outlet;

a compressor mechanism disposed within said interior space defined by said shell;

a drive member driving said compression mechanism;

a discharge muffler disposed in said exterior space defined by said shell, said discharge muffler having a discharge muffler inlet in communication with the discharge outlet and a discharge muffler outlet, said discharge muffler inlet and said discharge muffler outlet defining an axis of said discharge muffler; and at least one spacer disposed through said discharge muffler in a direction transverse to said axis, said spacer being received within said fitting.

* * * * *

UNITED STATES PATENT AND TRADEMARK OFFICE

CERTIFICATE OF CORRECTION

PATENT NO. : 8,057,194 B2
APPLICATION NO. : 11/998442
DATED : November 15, 2011
INVENTOR(S) : Christopher Stover It is certified that error appears in the above-identified patent and that said Letters Patent is hereby corrected as shown below:

| | |
|---|---|
| Column 1, Lines 61-62 | "compressors" should be --compressor--. |
| Column 2, Line 5 | "in reverse in" should be --in reverse is--. |
| Column 2, Line 50 | "a exploded" should be --an exploded--. |
| Column 3, Line 7 | "an closed" should be --a closed--. |
| Column 3, Line 13 | "an closed" should be --a closed--. |
| Column 5, Line 7 | After "maybe", insert --attached--. |
| Column 6, Line 58 | After "corresponds" insert --to--. |
| Column 8, Line 28 | "temperatures" should be --temperature--. |

Signed and Sealed this
Eighth Day of May, 2012

David J. Kappos

David J. Kappos
*Director of the United States Patent and Trademark Office*